US011342712B2

(12) United States Patent
Doi

(10) Patent No.: US 11,342,712 B2
(45) Date of Patent: May 24, 2022

(54) ELECTRICAL CONNECTOR TERMINAL COMPRISING TWO OVERLAPPING TERMINAL PIECES

(71) Applicant: HIROSE ELECTRIC CO., LTD., Kanagawa (JP)

(72) Inventor: Kentaro Doi, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/036,956

(22) Filed: Sep. 29, 2020

(65) Prior Publication Data

US 2021/0104840 A1 Apr. 8, 2021

(30) Foreign Application Priority Data

Oct. 2, 2019 (JP) ..... JP2019-182007

(51) Int. Cl.
*H01R 13/115* (2006.01)
*H01R 13/631* (2006.01)

(52) U.S. Cl.
CPC ..... *H01R 13/6315* (2013.01); *H01R 13/115* (2013.01)

(58) Field of Classification Search
CPC ... H01R 13/6315; H01R 13/115; H01R 12/91
See application file for complete search history.

(56) References Cited

U.S. PATENT DOCUMENTS 6,217,386 B1 * 4/2001 Zhang ..... H01R 13/658 439/607.11
9,397,432 B2 * 7/2016 Yukutake ..... H01R 13/46
9,455,530 B2 * 9/2016 Patel ..... H01R 13/6597

FOREIGN PATENT DOCUMENTS

JP 2017-117734 A 6/2017
JP 2019-33035 A 2/2019

OTHER PUBLICATIONS

Extended European Search Report (EESR) dated Feb. 26, 2021 issued in the corresponding European Patent Application No. 20199686.5.

* cited by examiner

*Primary Examiner* — Vanessa Girardi
(74) *Attorney, Agent, or Firm* — Rankin, Hill & Clark LLP

(57) ABSTRACT

An electrical connector is provided which includes a terminal that includes two terminal pieces, a fixed housing that is fixed to a machine or a substrate, and a movable housing that is movably supported to the fixed housing by the terminal. Each of the terminal pieces is formed of a conductive plate. A connection portion is formed on one end side of each of the terminal pieces in a length direction and connected to a circuit provided in the machine or the substrate. A contact portion is formed on another end side of each of the terminal pieces in the length direction and comes in contact with a terminal of a mating connector. A spring portion is formed in each of the terminal pieces and connects the connection portion and the contact portion such that the contact portion is movable with respect to the connection portion between the connection portion and the contact portion. The two terminal pieces are disposed such that at least parts of the spring portions of the two terminal pieces are overlapped via a gap in a direction perpendicular to a surface of the spring portion.

7 Claims, 20 Drawing Sheets

ELECTRICAL CONNECTOR TERMINAL COMPRISING TWO OVERLAPPING TERMINAL PIECES

CROSS-REFERENCE TO RELATED APPLICATION

This application claims priority from Japanese Patent Application No. 2019-182007 filed with the Japan Patent Office on Oct. 2, 2019, the entire content of which is hereby incorporated by reference.

BACKGROUND

1. Technical Field

The disclosure relates to an electrical connector which has a floating function.

2. Related Art

Some electrical connectors have a floating function. The floating function is a function in which a positional deviation of a connector is absorbed even in a case where a mating connector is deviated with respect to the connector so as to make it possible to connect the connector and the mating connector, and the connection between the connector and the mating connector is maintained. Hereinbelow, the electrical connector having the floating function will be referred to as a floating connector.

The terminal provided in the floating connector includes a connection portion to be connected to a circuit provided in a machine or a substrate, a contact portion to be in contact with the mating connector, and a spring portion to be connected between the connection portion and the contact portion. In addition, the floating connector includes a fixed housing to be fixed to the machine or the substrate, and a movable housing capable of moving with respect to the fixed housing. In the movable housing, an insertion portion where the terminal of the mating connector is inserted is provided. The contact portion of the terminal of the floating connector is disposed in the insertion portion of the movable housing. In the floating connector, the connection portion of the terminal is connected to a circuit provided in the machine or the substrate so as to be fixed to the machine or the substrate, and the portion on the contact portion side of the terminal is fixed to the movable housing. With this structure, the movable housing can move with respect to the fixed housing by an elastic deformation of the spring portion of the terminal.

JP-A-2019-33035 discloses an example of the floating connector.

SUMMARY

An electrical connector according to the disclosure includes a fixed housing that is fixed to a machine or a substrate and a movable housing that is movably supported to the fixed housing by the terminal. Each of the terminal pieces is formed of a conductive plate. A connection portion is formed on one end side of each of the terminal pieces in a length direction and connected to a circuit provided in the machine or the substrate. A contact portion is formed on another end side of each of the terminal pieces in the length direction and comes in contact with a terminal of a mating connector. A spring portion is formed in each of the terminal pieces and connects the connection portion and the contact portion such that the contact portion is movable with respect to the connection portion between the connection portion and the contact portion. The two terminal pieces are disposed such that at least parts of the spring portions of the two terminal pieces are overlapped via a gap in a direction perpendicular to a surface of the spring portion.

DETAILED DESCRIPTION

Figure 1:
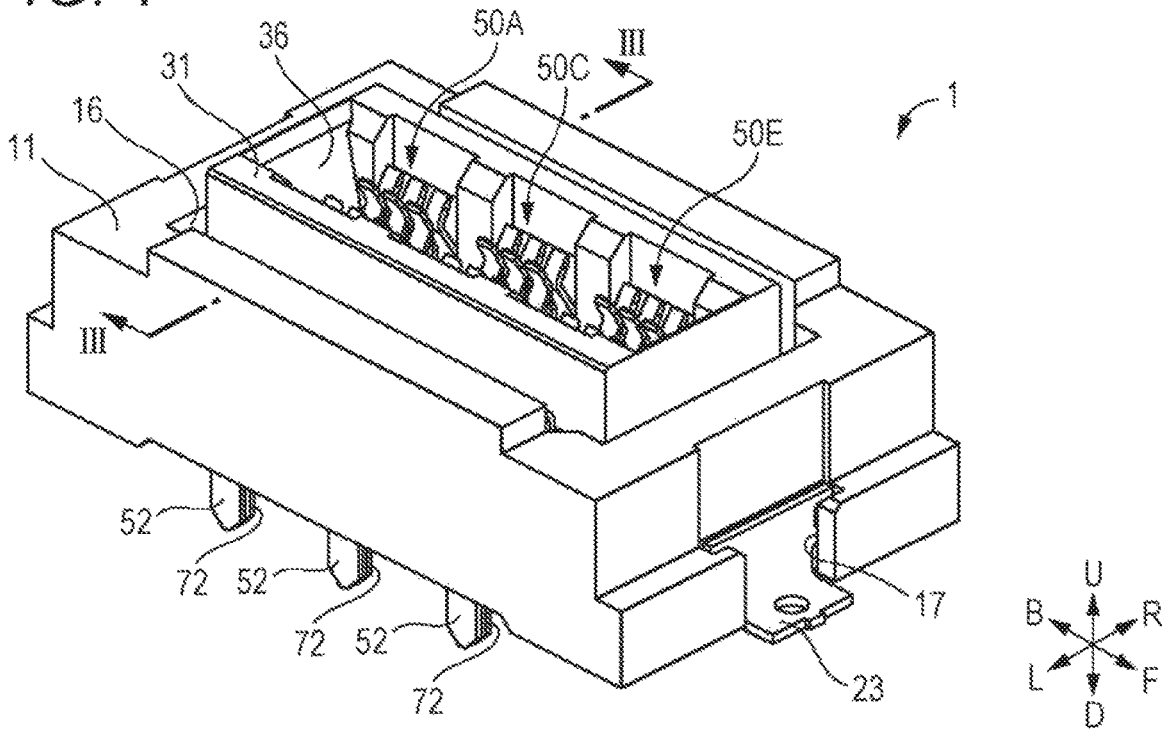
FIG. 1 is a perspective view illustrating a connector according to a first embodiment of the disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

For example, when realizing a floating connector including a power source terminal, there is a need to increase the current capacity of the power source terminal.

In general, the current capacity of the ter al can be increased by increasing the terminal in thickness. However, when the terminal is increased in thickness, the elastic deformation of a spring portion of the terminal is hard. Therefore, a moving amount of a movable housing with respect to a fixed housing is reduced.

In addition, even in a case where the terminal is made thick, the elastic deformation of the spring portion of the terminal can be easy by increasing the length of the terminal, and the moving amount of the movable housing with respect to the fixed housing can be increased. However, the floating connector is increased in size if the length of the terminal is increased.

With this regard, JP-A-2019-33035 discloses a floating connector in which a slit is formed in an elastic portion between a connection portion and a contact portion of the power source terminal.

Of course, the elastic deformation of the elastic portion of the power source terminal can be made easy by forming the slit in the elastic portion of the power source terminal. However, there is a demerit that the current capacity of the power source terminal decreases as much as the slit formed in the elastic portion of the power source terminal.

The disclosure has been made, for example, in view of the above problem, and an object thereof is to provide an electrical connector which can increase the current capacity of the terminal, secure a sufficient moving amount of the movable housing with respect to the fixed housing, and achieve a miniaturization.

In order to solve the above problem, the electrical connector according to an embodiment of the disclosure includes a terminal that includes two terminal pieces, a fixed housing that is fixed to a machine or a substrate, and a movable housing that is movably supported to the fixed housing by the terminal. Each of the terminal pieces is formed of a conductive plate. A connection portion is formed on one end side of each of the terminal pieces in a length direction and connected to a circuit provided in the machine or the substrate. A contact portion is formed on another end side of each of the terminal pieces in the length direction and comes in contact with a terminal of a mating connector. A spring portion is formed in each of the terminal pieces and connects the connection portion and the contact portion such that the contact portion is movable with respect to the connection portion between the connection portion and the contact portion. The two terminal pieces are disposed such that at least parts of the spring portions of the two terminal pieces are overlapped via a gap in a direction perpendicular to a surface of the spring portion.

In addition, in the electrical connector according to the embodiment of the disclosure, an insertion portion may be provided in the movable housing to insert the terminal of the mating connector. The contact portion of each of the terminal pieces may include a contact surface to be in contact with the terminal of the mating connector. The contact portion of each of the two terminal pieces may be disposed in the insertion portion such that the contact surfaces of the contact portions face each other. In addition, in the electrical connector according to the embodiment of the disclosure, a size of a gap between the spring portions of the two terminal pieces may be changed in a process that the spring portions of the two terminal pieces extend from the connection portions of the two terminal pieces to the contact portions of the two terminal pieces. In addition, in the electrical connector according to the embodiment of the disclosure, a slit may be formed in the spring portion of each of the terminal pieces such that the slit passes through the terminal piece from a front surface to a rear surface, and extends in a length direction of the terminal piece. In addition, in the electrical connector according to the embodiment of the disclosure, the spring portion of each of the two terminal pieces may be divided into a plurality of elongated spring elements by the slit. A width of each of the spring elements may be changed in a process that the spring element extends from the connection portion to the contact portion. In addition, in the electrical connector according to the embodiment of the disclosure, a plurality of the terminals and a plurality of the movable housings are provided. The plurality of the movable housings may be independently and movably supported to the fixed housing by the plurality of the terminals.

According to an embodiment of the disclosure, the current capacities of the terminals can be increased, a sufficient moving amount of the movable housing with respect to the fixed housing can be secured, and the electrical connector can be miniaturized.

Embodiments of the electrical connector of the disclosure will be described using the drawings. Further, regarding the embodiments of the disclosure, when describing the directions of upper (U), lower (D), front (F), rear (B), left (L) or right (R), arrows will be drawn on the lower right in FIGS. 1 to 12, and 15 to 20.

First Embodiment

Figure 2:
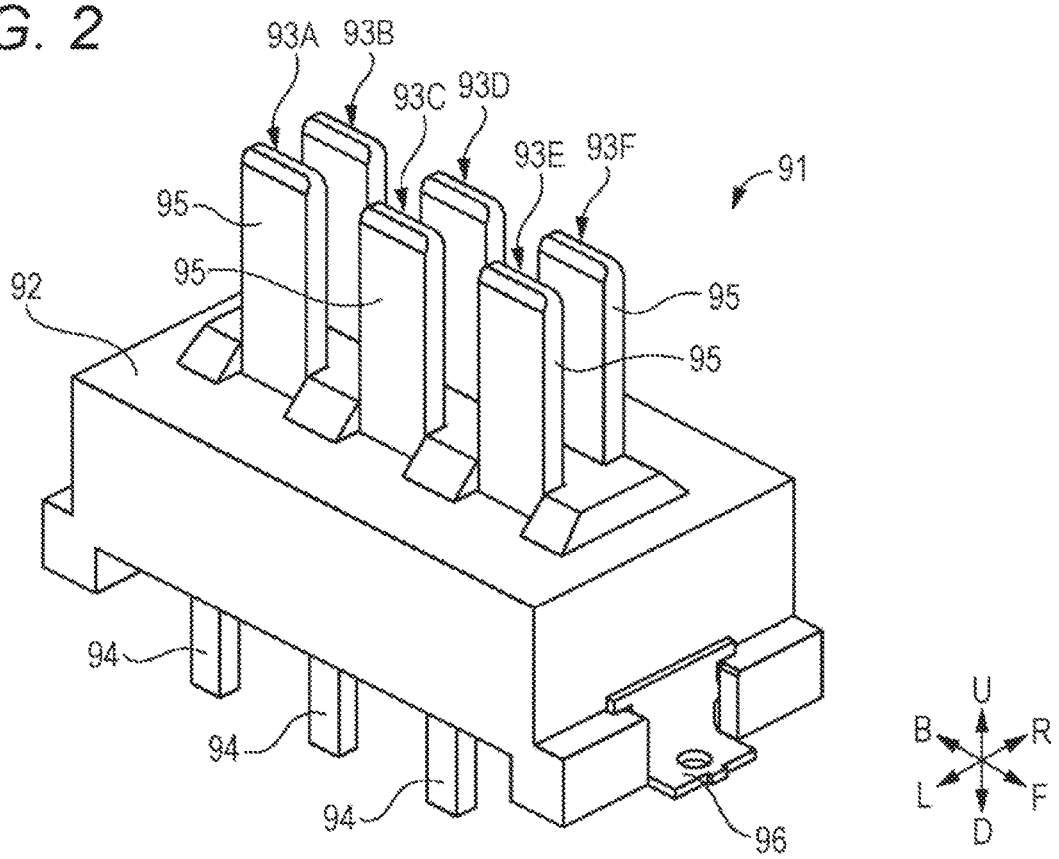
FIG. 2 is a perspective view illustrating a mating connector which is connectable to the connector according to the first embodiment of the disclosure.
Figure 3:
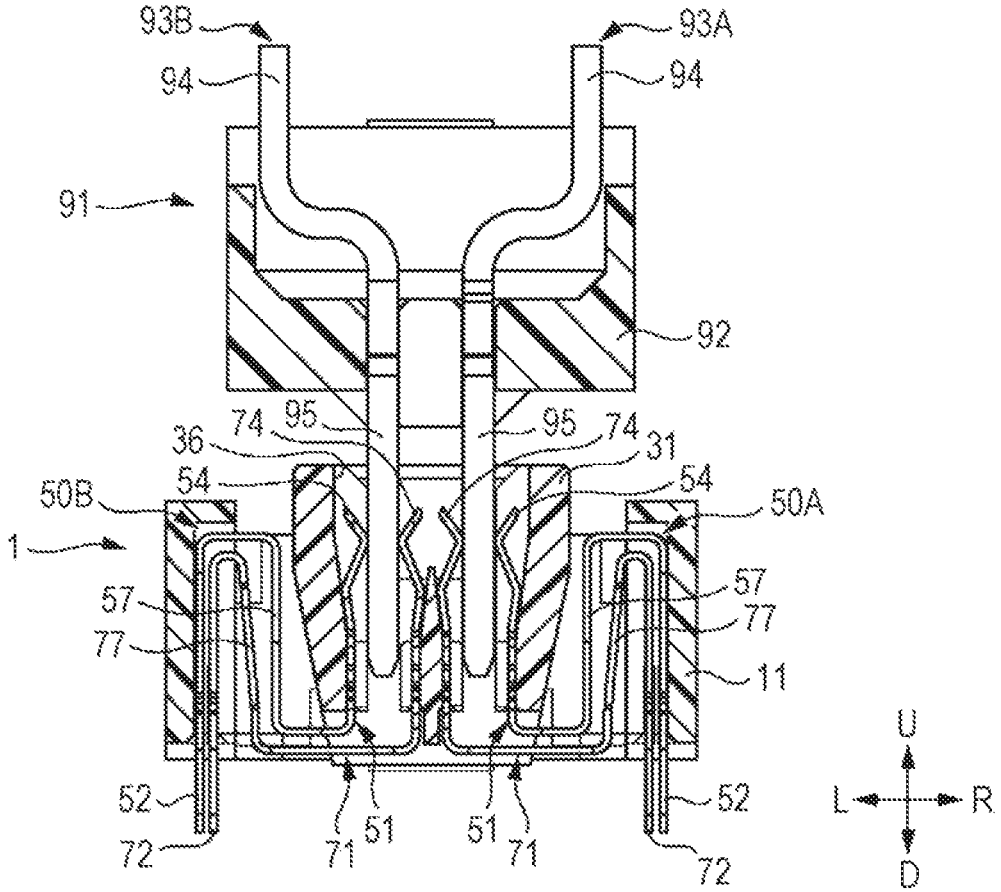
FIG. 3 is a cross-sectional view illustrating a state in which the mating connector is connected to the connector according to the first embodiment of the disclosure.

FIG. 1 illustrates a connector 1 of the electrical connector according to a first embodiment of the disclosure, and FIG. 2 illustrates a mating connector 91 which can be connected with the connector 1. FIG. 3 illustrates a cross section of the connector 1 and the mating connector 91 connected to each other, when viewed from the direction of arrow III-III in FIG. 1. The connector 1 illustrated in FIG. 1 is the floating connector. The connector 1 is mounted on, for example, a substrate. In addition, the mating connector 91 illustrated in FIG. 2 is mounted on, for example, another substrate. A circuit on the substrate where the connector 1 is mounted and a circuit on the other substrate where the mating connector 91 is mounted can be connected to each other by connecting the connector 1 and the mating connector 91 to each other as illustrated in FIG. 3. In addition, in this embodiment, the connector 1 and the mating connector 91 each are used as a power source connector which supplies the current of the power source from one circuit on the substrate where the connector 1 is mounted to the other circuit on the substrate where the mating connector 91 is mounted, or vice versa.

The mating connector 91 includes a cuboid housing 92 made of an insulating material, and a plurality of terminals 93A to 93F made of a conductive material as illustrated in FIG. 2. A connection portion 94 is formed on the lower end side of each of the terminals 93A to 93F to connect the circuit on the substrate where the mating connector 91 is mounted. In addition, a contact portion 95 is formed on the upper end side of each of the terminals 93A to 93F for the contact with contact portions 54 and 74 of each of the terminal pieces 51 and 71 of the terminals 50A to 50F of the connector 1. The connection portion 94 of each of the terminals 93A to 93F protrudes downward from the housing 92, and the contact portion 95 of each of the terminals 93A to 93F protrudes upward from the housing 92. In addition, the housing 92 is fixed to the substrate, where the mating connector 91 is mounted, through a pair of fixed metal fittings 96 (only the front side illustrated). Further, when the mating connector 91 is connected to the connector 1, the mating connector 91 is inverted upside down as illustrated in FIG. 3.

Figure 4:
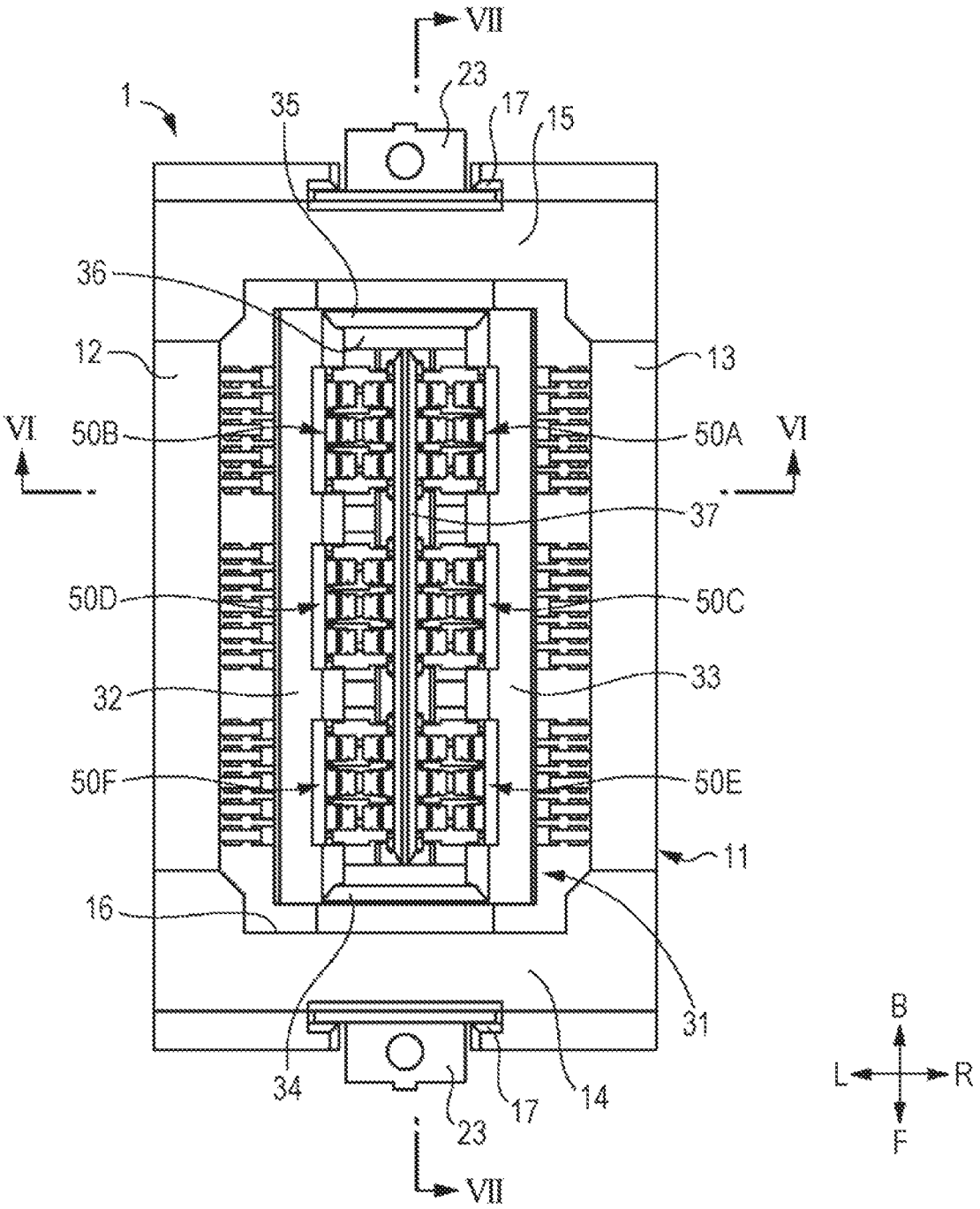
FIG. 4 is a diagram illustrating the connector according to the first embodiment of the disclosure when viewed from above.
Figure 5:
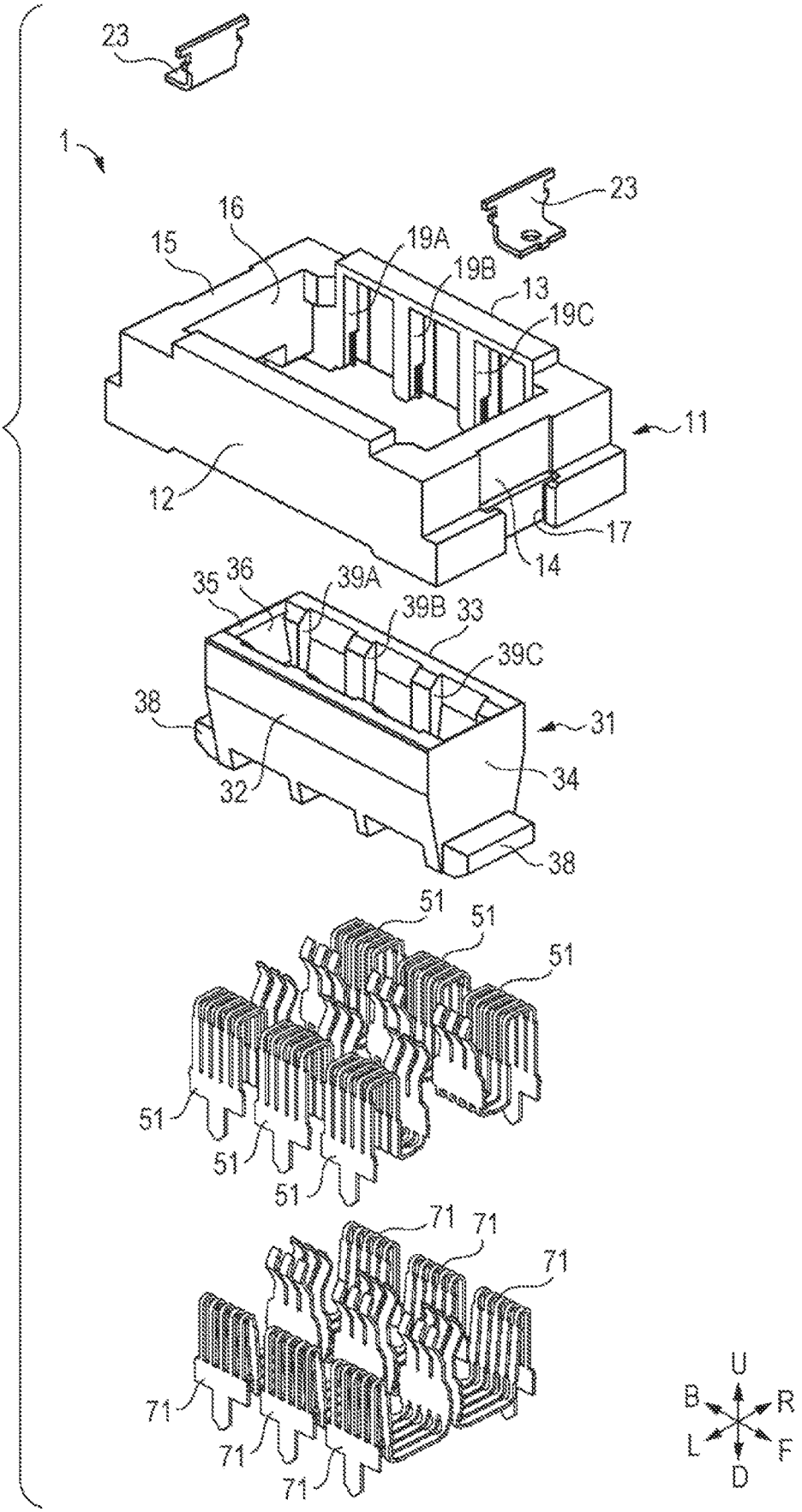
FIG. 5 is an exploded view of the connector according to the first embodiment of the disclosure.
Figure 6:
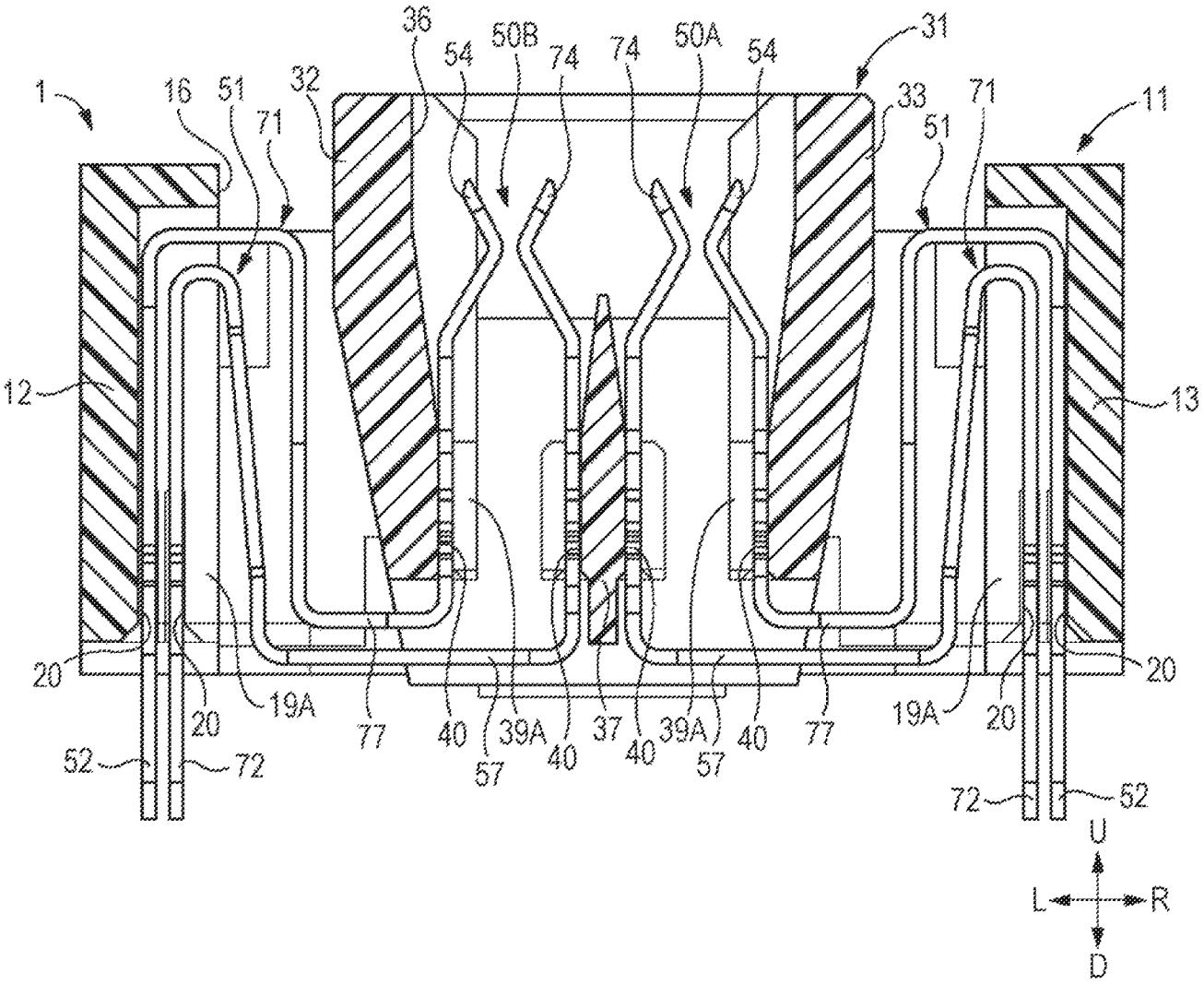
FIG. 6 is a cross-sectional view illustrating the connector when viewed in the direction of arrow VI-VI in FIG. 4.
Figure 7:
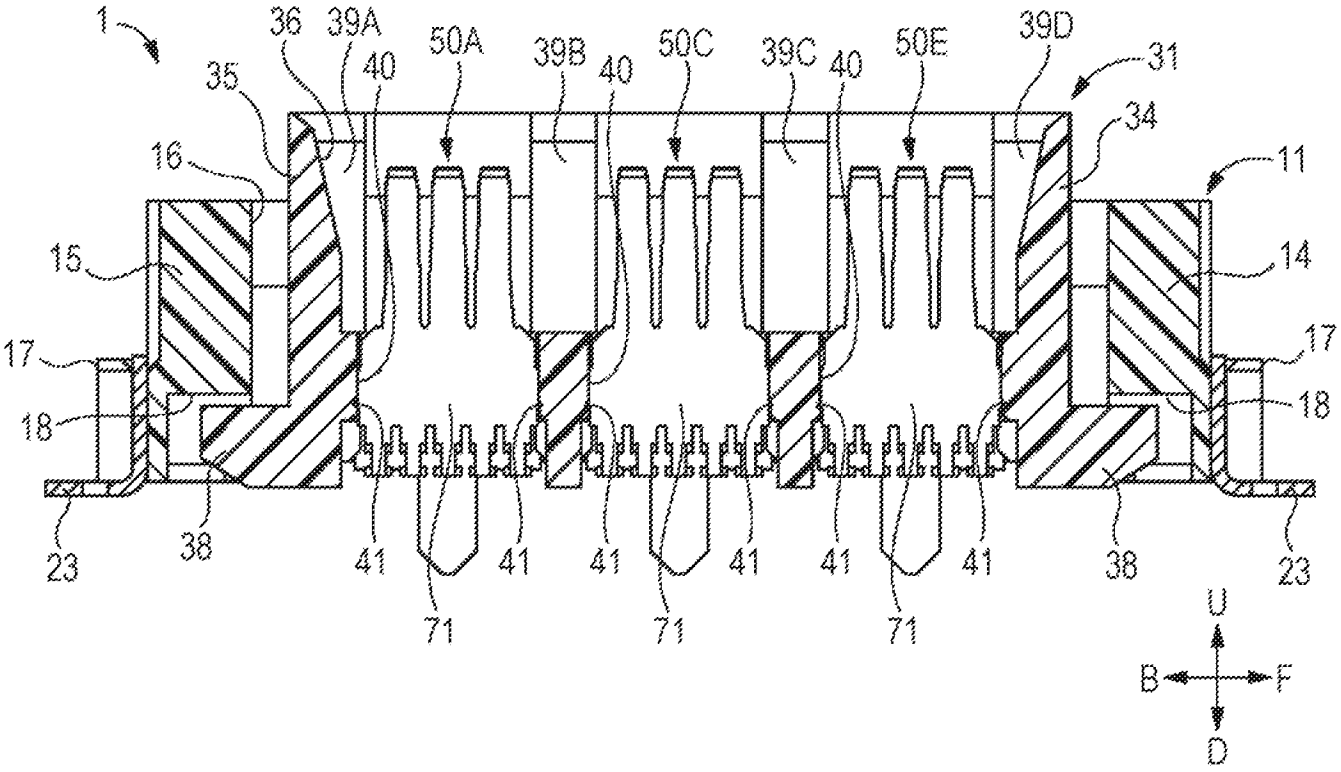
FIG. 7 is a cross-sectional view illustrating the connector when viewed in the direction of arrow VII-VII in FIG. 4.

FIG. 4 illustrates a state when the connector 1 is viewed from above, and FIG. 5 illustrates a state when the connector 1 is exploded. FIG. 6 illustrates a cross section of the connector 1 when viewed from the direction of arrow VI-VI in FIG. 4, and FIG. 7 illustrates a cross section of the connector 1 when viewed from the direction of arrow VII-VII in FIG. 4. The connector 1 includes a fixed housing 11, a pair of fixed metal fittings 23, a movable housing 31, and six terminals 50A to 50F as illustrated in FIG. 4. In addition, as illustrated in FIG. 5, each of the terminals 50A to 50F includes two terminal pieces 51 and 71.

In FIG. 5, the fixed housing 11 is formed in a substantially rectangular cylindrical shape using an insulating material such as resin, and includes a left wall portion 12, a right wall portion 13, a front wall portion 14, and a rear wall portion 15. In addition, a storage portion 16 is formed inside the fixed housing 11 to store the movable housing 31 and each of the terminals 50A to 50F. In addition, as illustrated in FIGS. 4 and 7, a metal fitting attachment portion 17 is formed in each of the center in the lateral direction of the front lower part of the front wall portion 14 and the center in the lateral direction of the rear lower part of the rear wall portion 15 in order to attach the fixed metal fitting 23. The fixed housing 11 is fixed to the substrate, where the connector 1 is mounted, by the fixed metal fitting 23 attached to the front and rear metal fitting attachment portions 17.

In addition, as illustrated in FIG. 7, a notch 18 is formed in each of the center in the lateral direction of the lower part of the front wall portion 14 and the center in the lateral direction of the lower part of the rear wall portion 15 in order to insert a convex portion 38 of the movable housing 31. The movable housing 31 is movably supported to the fixed housing 11 by inserting the front and rear convex portions 38 of the movable housing 31 into the front and rear notches 18 of the fixed housing 11.

Figure 8:
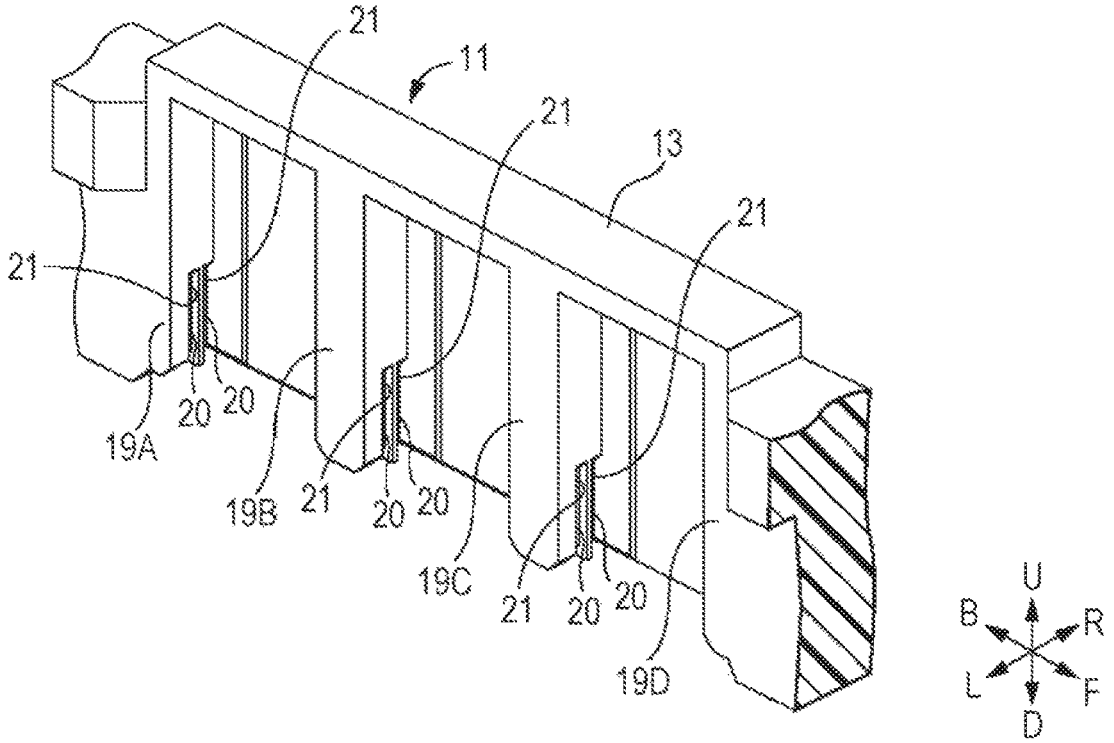
FIG. 8 is a perspective view illustrating a right wall portion of a fixed housing in the connector according to the first embodiment of the disclosure.

In addition, FIG. 8 illustrates the right wall portion 13 of the fixed housing 11. As illustrated in FIG. 8, four terminal support portions 19A, 19B, 19C, and 19D are formed in the left surface (inner surface) of the right wall portion 13 of the fixed housing 11 in order to support a first terminal piece 51 and a second terminal piece 71 of each of the terminals 50A, 50C, and 50E. The terminal support portions 19A, 19B, 19C, and 19D each protrude from the left surface of the right wall portion 13 toward the left side.

Specifically, the first terminal piece 51 and the second terminal piece 71 of the terminal 50A are supported between the terminal support portions 19A and 19B of the right wall portion 13 of the fixed housing 11. Two terminal support grooves 20 are formed in the front surface of the terminal support portion 19A to be parallel to each other on the right and left sides. Among these terminal support grooves 20, a part of the rear end of the first terminal piece 51 of the terminal 50A is inserted into the right terminal support groove 20, and a part of the rear end of the second terminal piece 71 of the terminal 50A is inserted into the left terminal support groove 20. In addition, two terminal support grooves (not illustrated) are formed in the rear surface of the terminal support portion 19B to be symmetrical in the front-rear direction with respect to the two terminal support grooves 20 formed in the front surface of the terminal support portion 19A. Among these terminal support grooves, a part of the front end of the first terminal piece 51 of the terminal 50A is inserted into the right terminal support groove, and a part of the front end of the second terminal piece 71 of the terminal 50A is inserted into the left terminal support groove. In addition, an engaging concave portion 21 is formed in the bottom surface of each of these four terminal support grooves 20 in order to engage the first terminal piece 51 or the second terminal piece 71.

In addition, the first terminal piece 51 and the second terminal piece 71 of the terminal 50C are supported between the terminal support portions 19B and 19C of the right wall portion 13 of the fixed housing 11. The front surface of the terminal support portion 19B and the rear surface of the terminal support portion 19C are also formed with the terminal support groove 20 and the engaging concave portion 21 similarly to the front surface of the terminal support portion 19A and the rear surface of the terminal support portion 19B. In addition, the first terminal piece 51 and the second terminal piece 71 of the terminal 50E are supported between the terminal support portions 19C and 19D of the right wall portion 13 of the fixed housing 11. The front surface of the terminal support portion 19C and the rear surface of the terminal support portion 19D are also formed with the terminal support groove 20 and the engaging concave portion 21 similarly to the front surface of the terminal support portion 19A and the rear surface of the terminal support portion 19B.

In addition, as a structure for supporting the first terminal piece 51 and the second terminal piece 71 of each of the terminals 50B, 50D, and 50F, the terminal support portions 19A, 19B, 19C, and 19D formed in the left surface of the right wall portion 13 of the fixed housing 11, the same terminal support portions as the terminal support groove 20 and the engaging concave portion 21, the terminal support groove 20 (see FIG. 6), and the engaging concave portion are formed in the right surface (inner surface) of the left wall portion 12 of the fixed housing 11.

The movable housing 31 is made of an insulating material such as resin in a substantially rectangular cylindrical shape as illustrated in FIG. 5, and includes a left wall portion 32, a right wall portion 33, a front wall portion 34, and a rear wall portion 35. In addition, inside the movable housing 31, the contact portion 54 of the first terminal piece 51 and the contact portion 74 of the second terminal piece 71 of each of the terminals 50A to 50F are disposed, and an insertion portion 36 is formed into which the contact portion 95 of each of the terminals 93A to 93F of the mating connector 91 is inserted. In addition, as illustrated in FIG. 6, a partition portion 37 is formed in the insertion portion 36. The partition portion 37 extends between the center in the lateral direction of the lower part of the front wall portion 34 and the center in the lateral direction of the lower part of the rear wall portion 35. In addition, as illustrated in FIG. 5 or 7, the convex portion 38 is formed in the lower part of the front surface (outer surface) of the front wall portion 34 to protrude forward. The convex portion 38 is formed in the lower part of the rear surface (outer surface) of the rear wall portion 35 to protrude backward. As described later, these front and rear convex portions 38 each are inserted into the front and rear notches 18 of the fixed housing 11, so that the movable housing 31 is movably supported to the fixed housing 11.

Figure 9:
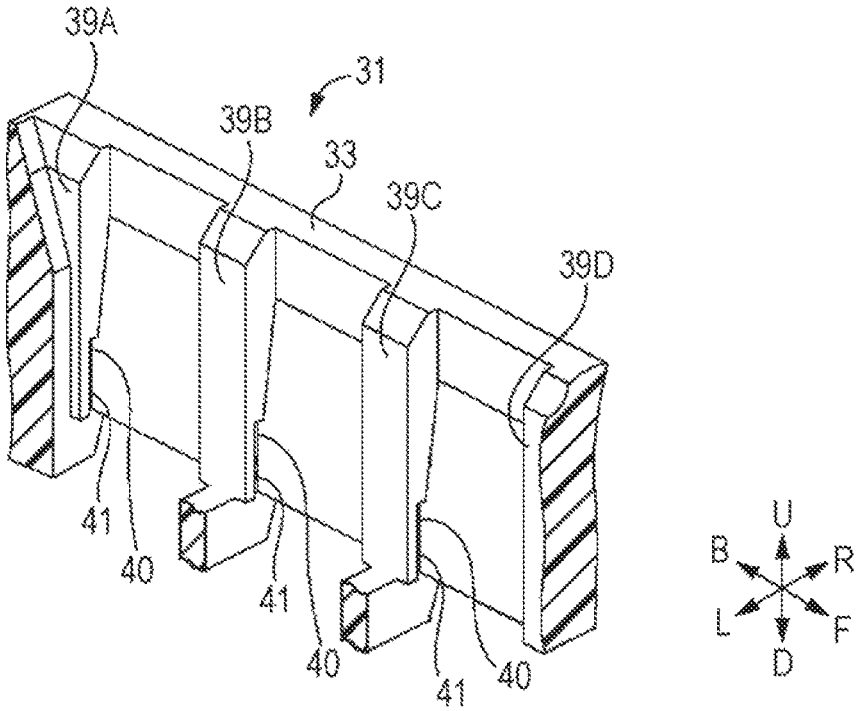
FIG. 9 is a perspective view illustrating the right wall portion of a movable housing in the connector according to the first embodiment of the disclosure.

In addition, FIG. 9 illustrates the right wall portion 33 of the movable housing 31. As illustrated in FIG. 9, four terminal support portions 39A, 39B, 39C, and 39D are formed in the left surface (inner surface) of the right wall portion 33 of the movable housing 31 in order to support the first terminal piece 51 of each of the terminals 50A, 50C, and 50E. Each of the terminal support portions 39A, 39B, 39C, and 39D protrude from the left surface of the right wall portion 33 toward the left side.

Specifically, the first terminal piece 51 of the terminal 50A is supported between the terminal support portions 39A and 39B of the right wall portion 33 of the movable housing 31. A terminal support groove 40 is formed in the front surface of the terminal support portion 39A in order to insert a part of the rear end of the first terminal piece 51 of the terminal 50A. In addition, a terminal support groove (not illustrated) is formed in the rear surface of the terminal support portion 39B in order to insert a part of the front end of the first terminal piece 51 of the terminal 50A. These terminal support grooves 40 are formed symmetrically to each other in the front-rear direction. In addition, an engaging concave portion 41 is formed in the bottom surface of each of these terminal support grooves 40 in order to engage the first terminal piece 51. In addition, the first terminal piece 51 of the terminal 50C is supported between the terminal support portions 39B and 39C of the right wall portion 33 of the movable housing 31. The front surface of the terminal support portion 39B and the rear surface of the terminal support portion 39C are also formed with the terminal support groove 40 and the engaging concave portion 41 similarly to the front surface of the terminal support portion 39A and the rear surface of the terminal support portion 39B. In addition, the first terminal piece 51 of the terminal 50E is supported between the terminal support portions 39C and 39D of the right wall portion 33 of the movable housing 31. The front surface of the terminal support portion 39C and the rear surface of the terminal support portion 39D are also formed with the terminal support groove 40 and the engaging concave portion 41 similarly to the front surface of the terminal support portion 39A and the rear surface of the terminal support portion 39B.

In addition, as a structure for supporting the second terminal piece 71 of each of the terminals 50A, 50C, and 50E, the terminal support portions 39A, 39B, 39C, and 39D formed in the left surface of the right wall portion 33 of the movable housing 31, the same terminal support portions as the terminal support groove 40 and the engaging concave portion 41, the terminal support groove 40, and the engaging concave portion 41 are formed in the right surface of the partition portion 37 of the movable housing 31 (see FIG. 7). In addition, as a structure for supporting the first terminal piece 51 of each of the terminals 50B, 50D, and 50F, the terminal support portions 39A, 39B, 39C, and 39D formed in the left surface of the right wall portion 33 of the movable housing 31, the same terminal support portions as the terminal support groove 40 and the engaging concave portion 41, the terminal support groove 40 (see FIG. 6), and the engaging concave portion are formed in the right surface of the left wall portion 32 of the movable housing 31. In addition, as a structure for supporting the second terminal piece 71 of each of the terminals 50B, 50D, and 50F, the terminal support portions 39A, 39B, 39C, and 39D formed in the left surface of the right wall portion 33 of the movable housing 31, the same terminal support portions as the terminal support groove 40 and the engaging concave portion 41, the terminal support groove 40 (see FIG. 6), and the engaging concave portion are formed in the left surface of the partition portion 37 of the movable housing 31.

As illustrated in FIG. 4, the terminals 50A and 50B among six terminals 50A to 50F of the connector 1 are disposed on the right and left sides in the rear part of the connector 1, respectively. In addition, the terminals 50C and 50D are disposed on the right and left sides in the central portion in the front-rear direction of the connector 1, respectively. The terminals 50E and 50F are disposed on the right and left sides in the front part of the connector 1, respectively. In addition, as illustrated in FIG. 6, the terminals 50A and 50B are disposed bisymmetrically to each other. The terminals 50C and 50D are also disposed bisymmetrically to each other. Similarly, the terminals 50E and 50F are also disposed bisymmetrically to each other. In addition, the terminals 50A, 50C, and 50E are disposed in a line in the front-rear direction on the right part of the connector 1. The terminals 50B, 50D, and 50F are disposed in a line in the front-rear direction in the left part of the connector 1. In addition, as illustrated in FIGS. 5 and 6, each of the terminals 50A to 50F includes the first terminal piece 51 and the second terminal piece 71. Each of the terminal pieces 51 and 71 are formed by a conductive plate such as a metal plate.

Figure 10:
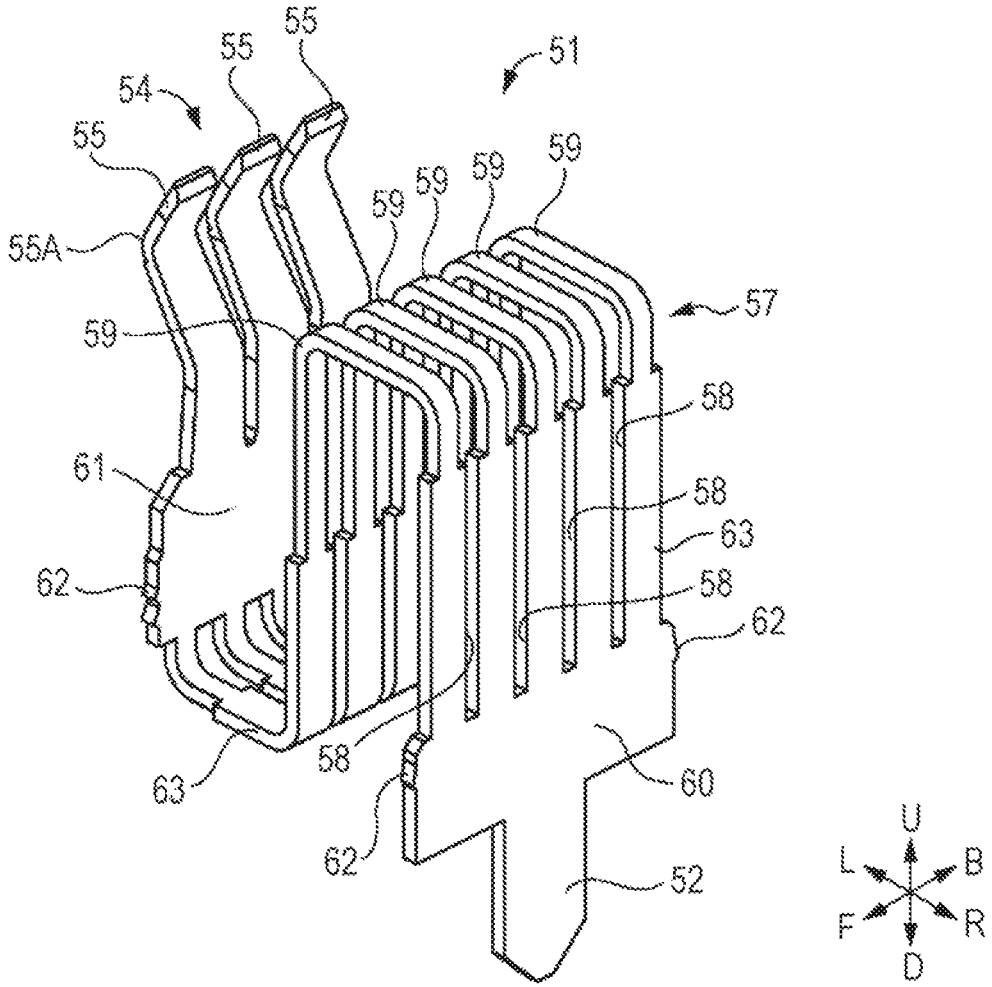
FIG. 10 is a perspective view illustrating a first terminal piece in the connector according to the first embodiment of the disclosure.
Figure 11:
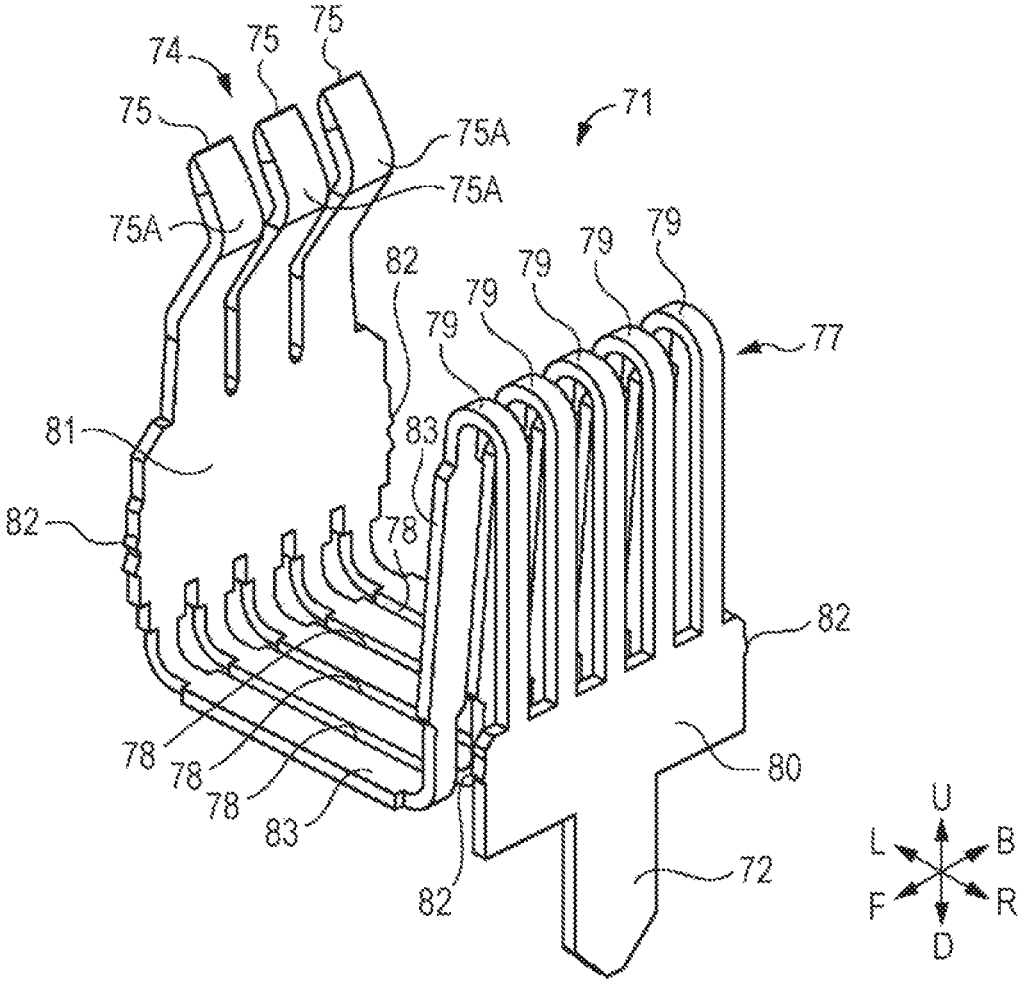
FIG. 11 is a perspective view illustrating a second terminal piece in the connector according to the first embodiment of the disclosure.
Figure 12:
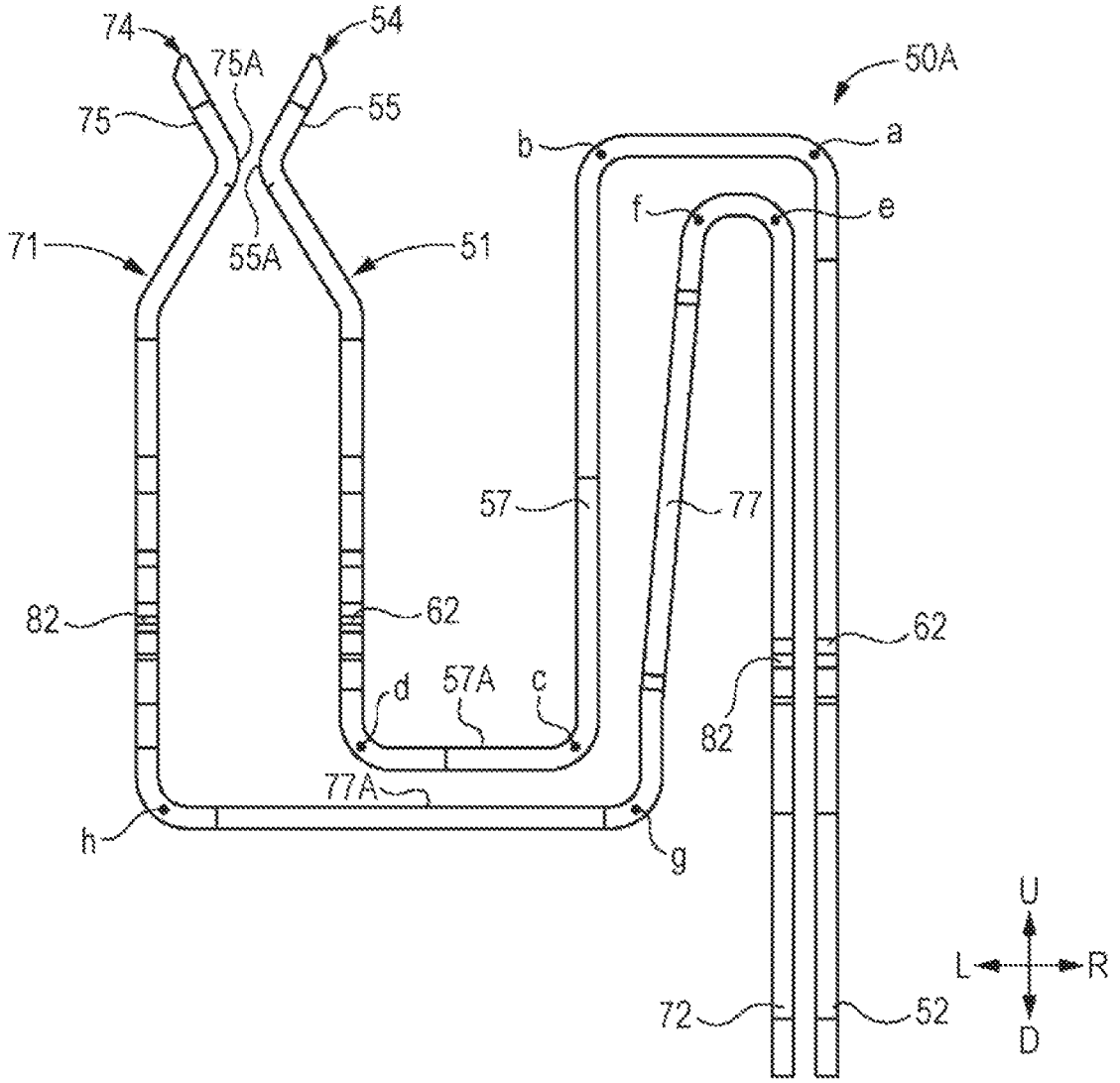
FIG. 12 is a diagram illustrating a terminal of the connector according to the first embodiment of the disclosure.

FIG. 10 illustrates the first terminal piece 51 of the terminal 50A, and FIG. 11 illustrates the second terminal piece 71 of the terminal 50A. FIG. 12 illustrates the terminal 50A when viewed from the front side.

The first terminal piece 51 of the terminal 50A includes, as illustrated in FIG. 10, a connection portion 52 to be connected to a circuit provided in the machine or the substrate, the contact portion 54 to come in contact with the contact portion 95 of a terminal 93A of the mating connector 91, and a spring portion 57 to connect the connection portion 52 and the contact portion 54 such that the contact portion 54 becomes movable in the left-right direction, the front-rear direction, and the up-down direction with respect to the connection portion 52.

The connection portion 52 is formed on one end side of the first terminal piece 51 in the length direction. The connection portion 52 includes a single connector which extends in the up-down direction.

The contact portion 54 is formed on the other end side of the first terminal piece 51 in the length direction. The contact portion 54 includes three contactors 55. Each contactor 55 extends in the up-down direction. In addition, the upper end portion of each contactor 55 is bent in a "<" shape to protrude toward the left side. The left surface of the bent portion becomes a contact surface 55A which comes in contact with the contact portion 95 of the terminal 93A of the mating connector 91.

The spring portion 57 is formed between the connection portion 52 and the contact portion 54. In the spring portion 57, a plurality (for example, four) of slits 58 is formed which passes through the conductive plate forming the first terminal piece 51 from a surface 57A toward the rear surface, and extends in the length direction of the first terminal piece 51.

With the plurality of slits 58 formed in the spring portion 57, the spring portion 57 is divided into a plurality (for example, five) of spring elements 59. Each spring element 59 is structured as an elongated plate spring. Since the slits 58 are formed in the spring portion 57, and the spring portion 57 is divided into the plurality of spring elements 59, the spring portion 57 is easily elastically deformed.

In addition, as illustrated in FIG. 12, the spring portion 57 (each spring element 59) of the first terminal piece 51 is bent roughly in a crank shape or an S shape. Specifically, the spring portion 57 extends from the upper end portion of the connection portion 52 upward, extends leftward after being bent at position a to the left side, extends downward after being bent at position b to the lower side, extends leftward after being bent at position c to the left side, extends upward after being bent at position d to the upper side, and then reaches the lower end portion of the contact portion 54. By bending the spring portion 57 in this way, the spring portion 57 (each spring element 59) is made long, and the spring portion 57 can be easily elastically deformed, and it is possible to make a space required for arranging the spring portion 57 small.

In addition, as illustrated in FIG. 10, an engaging portion 62 is formed in each of the front end and the rear end of a joining portion 60 which joins the connection portion 52 and the spring portion 57. The front end and the rear end of the joining portion 60 of the first terminal piece 51 of the terminal 50A are respectively inserted into the right terminal support groove 20 in a pair of terminal support grooves 20 formed in the front surface of the terminal support portion 19A protruding from the left surface of the right wall portion 13 of the fixed housing 11, and the right terminal support groove in a pair of terminal support grooves formed on the rear surface of the terminal support portion 19B protruding from the left surface of the right wall portion 13 of the fixed housing 11. In addition, the engaging portion 62 formed in the joining portion 60 is engaged to the engaging concave portion 21 formed in the bottom surface of these terminal support grooves 20 (see FIG. 8).

In addition, the engaging portion 62 is also formed in each of the front end and the rear end of a joining portion 61 which joins the spring portion 57 and the contact portion 54. The front end and the rear end of the joining portion 61 of the first terminal piece 51 of the terminal 50A are respectively inserted into the terminal support groove 40 formed in the front surface of the terminal support portion 39A protruding from the left surface of the fight wall portion 33 of the movable housing 31, and the terminal support groove formed in the rear surface of the terminal support portion 39B protruding from the left surface of the right wall portion 33 of the movable housing 31. In addition, the engaging portion 62 formed in the joining portion 61 is engaged to the engaging concave portion 41 which is formed in the bottom surface of these terminal support grooves 40 (see FIG. 9).

In FIG. 11, the second terminal piece 71 of the terminal 50A includes, similarly to the first terminal piece 51 of the terminal 50A, a connection portion 72 to be connected to a circuit provided in the machine or the substrate, the contact portion 74 to come into contact with the contact portion 95 of the terminal 93A of the mating connector 91, and a spring portion 77 to connect the connection portion 72 and the contact portion 74 such that the contact portion 74 becomes movable in the left-right direction, the front-rear direction, and the up-down direction with respect to the connection portion 72.

The connection portion 72 includes a single connector which is formed one end side of the second terminal piece 71 in the length direction, and extends in the up-down direction. The contact portion 74 is formed on the other end of the second terminal piece 71 in the length direction, and includes three contactors 75. Each contactor 75 extends in the up-down direction, the upper end portion thereof is bent in a "<" shape to protrude to the right side, and the right surface of the bent portion becomes a contact surface 75A to come into contact with the contact portion 95 of the terminal 93A of the mating connector 91. The spring portion 77 is formed between the connection portion 72 and the contact portion 74. Similarly to the spring portion 57 of the first terminal piece 51, the spring portion 77 of the second terminal piece 71 is also formed with a plurality of slits 78, and thus the spring portion 77 is divided into a plurality of spring elements 79, each of which is structured as an elongated plate spring. Since the spring portion 77 is divided into the plurality of spring elements 79, the spring portion 77 is easily elastically deformed.

In addition, as illustrated in FIG. 12, the spring portion 77 (each spring element 79) of the second terminal piece 71 is bent in a substantially crank shape or an S shape. Specifically, the spring portion 77 extends from the upper end portion of the connection portion 72 upward, extends slightly leftward after being bent at position e to the left side, extends downward after being bent at position f to the lower side, extends leftward after being bent at position g to the left side, extends upward after being bent at position h to the upper side, and then reaches the lower end portion of the contact portion 74. By bending the spring portion 77 in this way, the spring portion 77 (each spring element 79) is made long, and the spring portion 77 can be easily elastically deformed, and it is possible to make a space required for arranging the spring portion 77 small.

In addition, as illustrated in FIG. 11, an engaging portion 82 is formed in each of the front end and the rear end of a joining portion 80 which joins the connection portion 72 and the spring portion 77. The front end and the rear end of the joining portion 80 of the second terminal piece 71 of the terminal 50A are respectively inserted into the left terminal support groove 20 in a pair of terminal support grooves 20 formed in the front surface of the terminal support portion 19A protruding from the left surface of the right wall portion 13 of the fixed housing 11, and the left terminal support groove in a pair of terminal support grooves formed on the rear surface of the terminal support portion 19B protruding from the left surface of the right wall portion 13 of the fixed housing 11. In addition, the engaging portion 82 formed in the joining portion 80 is engaged to the engaging concave portion 21 which is formed in the bottom surface of these terminal support grooves 20 (see FIG. 8).

In addition, the engaging portion 82 is also formed in each of the front end and the rear end of a joining portion 81 which joins the spring portion 77 and the contact portion 74. The front end and the rear end of the joining portion 81 of the second terminal piece 71 of the terminal 50A are respectively inserted into the terminal support groove 40 formed in the front surface of the terminal support portion 39A protruding from the right surface of the partition portion 37 of the movable housing 31, and the terminal support groove formed in the rear surface of the terminal support portion which is adjacent to the terminal support portion 39A in the front-rear direction. In addition, the engaging portion 82 formed in the joining portion 81 is engaged to the engaging concave portion 41 which is formed in the bottom surface of these terminal support grooves 40.

In addition, as illustrated in FIG. 12, the first terminal piece 51 and the second terminal piece 71 in the terminal 50A are disposed to be overlapped with a gap therebetween in the direction perpendicular to the surfaces 57A and 77A of the spring portions 57 and 77 until the spring portions 57 and 77 of the first terminal piece 51 and the second terminal piece 71 reach from one ends of the spring portions 57 and 77 in the length direction to the other ends.

In other words, as described already, the spring portion 57 of the first terminal piece 51 and the spring portion 77 of the second terminal piece 71 are disposed to be overlapped to each other in the up-down direction in a state of being separated from each other.

Described in detail, the portion from the upper end side of the connection portion 52 in the spring portion 57 of the first terminal piece 51 to position a is located on the right side of the portion from the upper end side of the connection portion 72 in the spring portion 77 of the second terminal piece 71 to position e. These portions are disposed to be overlapped to each other via a gap in the direction perpendicular to the surfaces of these portions, that is, the left-right direction. In addition, the portion from position a in the spring portion 57 of the first terminal piece 51 to position b is located on the upper side of the portion from position e in the spring portion 77 of the second terminal piece 71 to position f. These portions are disposed to be overlapped to each other via a gap in the direction perpendicular to the surfaces of these portions, that is, the up-down direction. In addition, the portion from position b in the spring portion 57 of the first terminal piece 51 to position c is located on the left side of the portion from position fin the spring portion 77 of the second terminal piece 71 to position g. These portions are disposed to be overlapped to each other via a gap in the direction perpendicular to the surfaces of these portions, that is, the left-right direction. In addition, the portion from position c in the spring portion 57 of the first terminal piece 51 to position d is located on the upper side of the portion from position g in the spring portion 77 of the second terminal piece 71 to position h. These portions are disposed to be overlapped to each other via a gap in the direction perpendicular to the surfaces of these portions, that is, the up-down direction. In addition, the portion from position d in the spring portion 57 of the first terminal piece 51 to the lower end side of the contact portion 54 is located on the right side of the portion from position h in the spring portion 77 of the second terminal piece 71 to the lower end side of the contact portion 74. These portions are disposed to be overlapped to each other via a gap in the direction perpendicular to the surfaces of these portions, that is, the left-right direction.

In addition, the spring portion 77 of the second terminal piece 71 extends along the spring portion 57 of the first terminal piece 51 from one end in the length direction to the other end. In addition, the slits 78 and the spring elements 79 formed in the spring portion 77 of the second terminal piece 71 extend in parallel to the slits 58 and the spring elements 59 formed in the spring portion 57 of the first terminal piece 51. In addition, the number of slits 78 and the number of spring elements 79 formed in the spring portion 77 are equal to the number of the slits 58 and the number of spring elements 59 formed in the spring portion 57.

In addition, in the terminal 50A, the contact portion 54 of the first terminal piece 51 and the contact portion 74 of the second terminal piece 71 are disposed such that the contact surfaces 55A and 75A face each other. In addition, in the terminal 50A, the connection portion 52 of the first terminal piece 51 and the connection portion 72 of the second terminal piece 71 are closely arranged in the left-right direction.

In addition, as illustrated in FIG. 12, the size of the gap between the spring portion 57 of the first terminal piece 51 and the spring portion 77 of the second terminal piece 71 is changed in the process that these spring portions 57 and 77 extend from the connection portions 52 and 72 to the contact portions 54 and 74. Specifically, the gap between the portion at position b in the spring portion 57 of the first terminal piece 51 and the portion at position fin the spring portion 77 of the second terminal piece 71 is larger than any of the gap between the portion at position a in the spring portion 57 of the first terminal piece 51 and the portion at position e in the spring portion 77 of the second terminal piece 71, and the gap between the portion at position c in the spring portion 57 of the first terminal piece 51 and the portion at position gin the spring portion 77 of the second terminal piece 71. With this structure, the contact portions 54 and 74 can easily move with respect to the connection portions 52 and 72 in the left-right direction.

Figure 13:
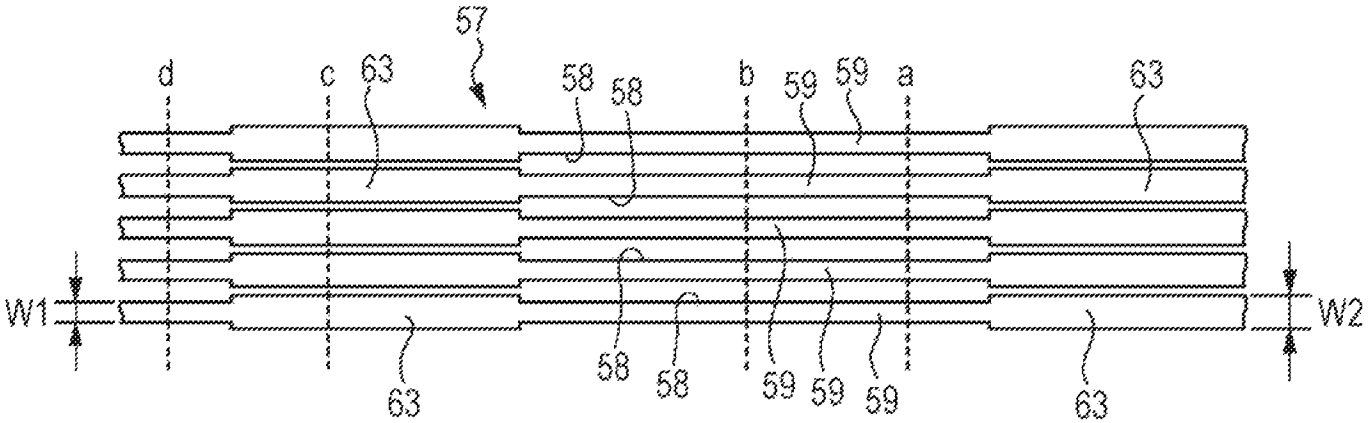
FIG. 13 is a diagram illustrating a state before a spring portion the first terminal piece in the connector according to the first embodiment of the disclosure is bent.
Figure 14:
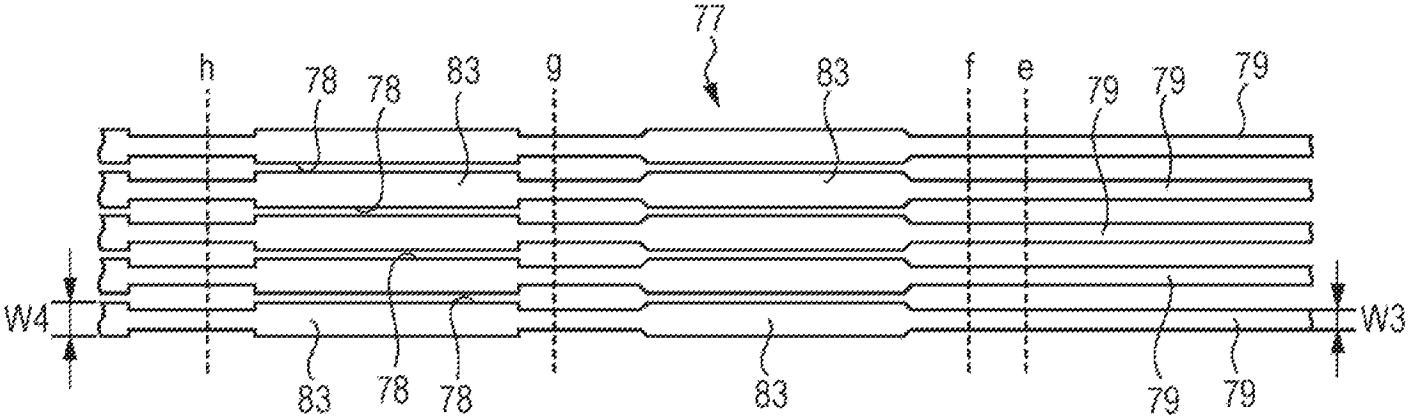
FIG. 14 is a diagram illustrating a state before a spring portion of the second terminal piece in the connector according to the first embodiment of the disclosure is bent.

FIG. 13 illustrates a state before the spring portion 57 of the first terminal piece 51 of the terminal 50A is bent, and FIG. 14 illustrates a state before the spring portion 77 of the second terminal piece 71 of the terminal 50A is bent. As illustrated in FIG. 13, in the first terminal piece 51 of the terminal 50A, the width of each spring element 59 is changed in the process that the spring element 59 extends from the connection portion 52 to the contact portion 54. In addition, as illustrated in FIG. 14, in the second terminal piece 71 of the terminal 50A, the width of each spring element 79 is changed in the process that the spring element 79 extends from the connection portion 72 to the contact portion 74. Specifically, as illustrated in FIG. 13, in each spring element 59 of the first terminal piece 51, a wide portion 63 having width W2 wider than width W1 of the other portion of the spring element 59 is formed in each of the portion from the upper end side of the connection portion 52 to the position before position a, and the portion from the middle position between position b and position c to the position beyond position c. In addition, as illustrated in FIG. 14, in each spring element 79 of the second terminal piece 71, a wide portion 83 having width W4 wider than width W3 of the other portion of the spring element 79 is formed in each of the substantially central portion between position f and position g and the substantially central portion between position g and position h. In each of the spring elements 59 and 79, the portions where the wide portions 63 and 83 are formed are hardly elastically deformed compared to the portion where the wide portions 63 and 83 are not formed. With the wide portions 63 and 83 formed in the spring elements 59 of the first terminal piece 51 and the spring elements 79 of the second terminal piece 71, the elastic deformation shapes of the spring elements 59 and 79 of the first terminal piece 51 and the second terminal piece 71 can be controlled. As a result, the spring element 59 of the first terminal piece 51 and the spring element 79 of the second terminal piece 71 interfere with each other in the process of elastic deformation, and can suppress that the spring portions 57 and 77 are hard to be elastically deformed.

Hitherto, the structures and shapes of the first terminal piece 51 and the second terminal piece 71, and the position of the second terminal piece 71 with respect to the first terminal piece 51 have been described about the terminal 50A using FIGS. 10 to 14. However, the structures and shapes of the first terminal piece 51 and the second terminal piece 71 in each of the terminals 50B to 50F are also the same as the structures and shapes of the first terminal piece 51 and the second terminal piece 71 in the terminal 50A. In addition, the position of the second terminal piece 71 with respect to the first terminal piece 51 in each of the terminals 50B to 50F is the same as the positions of the second terminal piece 71 with respect to the first terminal piece 51 in the terminal 50A.

The engaging portions 62 and 82 formed in the joining portion 60 of the first terminal piece 51 and the joining portion 80 of the second terminal piece 71 are inserted into the terminal support groove 20 of the fixed housing 11, and engaged to the engaging concave portion 21, so that each of the terminals 50A to 50F is fixed to the fixed housing 11. In addition, in the terminals 50A to 50F, the engaging portions 62 and 82 formed in the joining portion 61 of the first terminal piece 51 and the joining portion 81 of the second terminal piece 71 are inserted into the terminal support groove 40 of the movable housing 31, and engaged to the engaging concave portion 41, so that the movable housing 31 is movably supported to the fixed housing 11 by the terminals 50A to 50F.

As illustrated in FIG. 3, when the connector 1 and the mating connector 91 are connected, the contact portions 95 of the terminals 93A to 93F of the mating connector 91 are inserted into the insertion portions 36 of the movable housing 31 of the connector 1. As a result, the contact portions 95 of the terminals 93A to 93F of the mating connector 91 come into respective contact with the contact portion 54 of the first terminal piece 51 and the contact portion 74 of the second terminal piece 71 in the terminals 50A to 50F of the connector 1. Specifically, the contact portion 95 of the terminal 93A of the mating connector 91 enters between the contact portion 54 of the first terminal piece 51 and the contact portion 74 of the second terminal piece 71 in the terminal 50A of the connector 1. One surface of the contact portion 95 of the terminal 93A of the mating connector 91 in the left-right direction comes into contact with the contact surface 55A of each of three contactors 55 of the first terminal piece 51 in the terminal 50A of the connector 1. The other surface of the contact portion 95 of the terminal 93A of the mating connector 91 in the left-right direction comes into contact with the contact surface 75A of each of three contactors 75 of the second terminal piece 71 in the terminal 50A of the connector 1. In addition, the contact portion 95 of the terminal 93B of the mating connector 91 enters between the contact portion 54 of the first terminal piece 51 and the contact portion 74 of the second terminal piece 71 in the terminal 50B of the connector 1. One surface of the contact portion 95 of the terminal 93B of the mating connector 91 in the left-right direction comes into contact with the contact surface 55A of each of three contactors 55 of the first terminal piece 51 in the terminal 50B of the connector 1. The other surface of the contact portion 95 of the terminal 93B of the mating connector 91 in the left-right direction comes into contact with the contact surface 75A of each of three contactors 75 of the second terminal piece 71 in the terminal 50B of the connector 1. Similarly, the contact portions 95 of the terminals 93C to 93F of the mating connector 91 enter between the contact portion 54 of the first terminal piece 51 and the contact portion 74 of the second terminal piece 71 in the terminal 50C to 50F of the connector 1. The contact portions 95 of the terminals 93C to 93F of the mating connector 91 come into respective contact with the contact portions 54 and 74 in the terminal 50C to 50F of the connector 1.

In addition, in a case where the position of the mating connector 91 with respect to the connector 1 is deviated, the spring portion 57 of the first terminal piece 51 and the spring portion 77 of the second terminal piece 71 in the terminals 50A to 50F each are elastically deformed, and the movable housing 31 (the contact portions 54 and 74 of the first terminal piece 51 and the second terminal piece 71) moves in the left-right direction, the front-rear direction, or the up-down direction with respect to the fixed housing 11 (the connection portions 52 and 72 of the first terminal piece 51 and the second terminal piece 71). As a result, the deviation in position of the contact portion 95 of each terminal 93 of the mating connector 91 with respect to the contact portions 54 and 74 of the terminals 50A to 50F of the connector 1 is absorbed. Secure connection between the terminals 50A to 50F of the connector 1 and the terminals 93 of the mating connector 91 is achieved.

As described above, each of the terminals 50A to 50F of the connector 1 of the first embodiment of the disclosure includes the first terminal piece 51 having the spring portion 57 divided into the plurality of spring elements 59 and the second terminal piece 71 having the spring portion 77 divided into the plurality of spring elements 79. Then, the first terminal piece 51 and the second terminal piece 71 are disposed such that the spring portions 57 and 77 are overlapped to each other via the gap in the direction perpendicular to the surfaces 57A and 77A of the spring portions 57 and 77 from one ends to the other ends in the length direction of the spring portions 57 and 77. In the terminals 50A to 50F, the spring portions 57 and 77 of the first terminal piece 51 and the second terminal piece 71 are divided into the plurality of spring elements 59 and 79, so that the spring portions 57 and 77 each are easily elastically deformed. Therefore, the moving amount of the movable housing 31 with respect to the fixed housing 11 can be increased, and the floating function of the connector 1 can be increased. In addition, since each of the terminals 50A to 50F includes two terminal pieces 51 and 71, the current capacity of each of the terminals 50A to 50F can be increased, and it is possible to realize a power source connector capable of handling the power current of a high current value compared to a case where each of the terminals 50A to 50F includes a single terminal piece. In addition, in the terminals 50A to 50F, the first terminal piece 51 and the second terminal piece 71 are disposed such that the spring portions 57 and 77 are overlapped to each other via the gap in the direction perpendicular to the surfaces 57A and 77A of the spring portions 57 and 77 from one ends of the spring portions 57 and 77 in the length direction to the other ends. Therefore, most of the first terminal piece 51 and most of the second terminal piece 71 are close to each other. As a result, it is possible to save space required for disposing a terminal having the first terminal piece 51 and the second terminal piece 71. In this way, according to the connector of the first embodiment of the disclosure 1, the current capacities of the terminals 50A to 50F can be increased, a sufficient moving amount of the movable housing 31 with respect to the fixed housing 11 can be secured, and the connector 1 can be miniaturized.

In addition, in the terminals 50A to 50F of the connector 1 of the first embodiment of the disclosure 1, the contact portions 54 and 74 of the first terminal piece 51 and the second terminal piece 71 are disposed such that the contact surfaces 55A and 75A face each other in the insertion portion 36 of the movable housing 31. According to the structure in which the contact surfaces of two contact portions face each other, the contact surfaces are brought into simultaneous contact with both surfaces of the contact portion of the terminal of the mating connector. Therefore, even in the structure in which the movable housing moves with respect to the fixed housing, the stability in connection between the connector and the mating connector can be increased.

According to the connector of the first embodiment of the disclosure 1, the spring portions 57 and 77 of the first terminal piece 51 and the second terminal piece 71 are disposed to be overlapped via the gap in the direction perpendicular to these surfaces 57A and 77A, and also the contact surfaces 55A and 75A of the contact portions 54 and 74 of the first terminal piece 51 and the second terminal piece 71 face each other. Therefore, the stability in connection between the connector 1 and the mating connector 91 can be increased while minimizing the connector 1.

Second Embodiment

Figure 15:
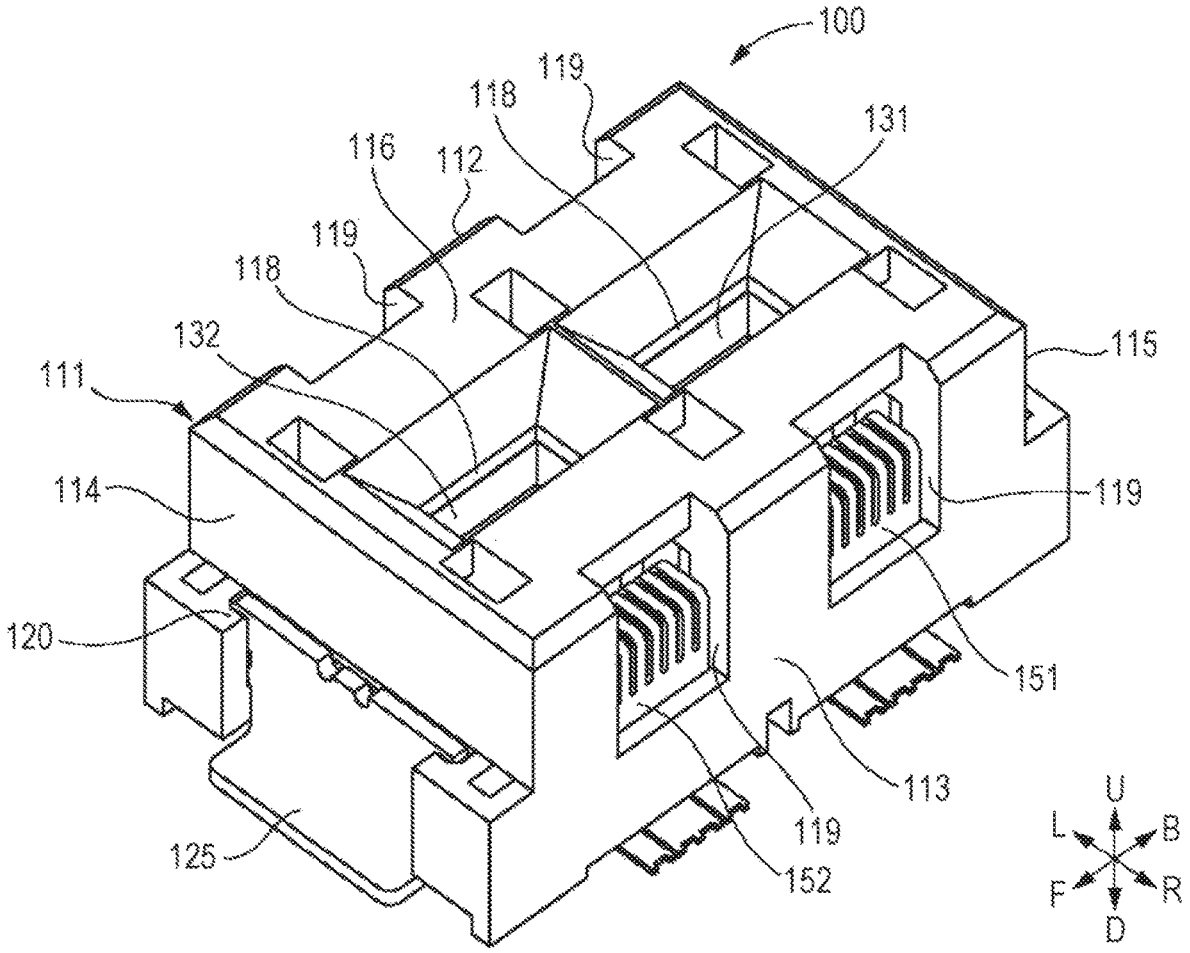
FIG. 15 is a perspective view illustrating the connector according to a second embodiment of the disclosure.
Figure 16:
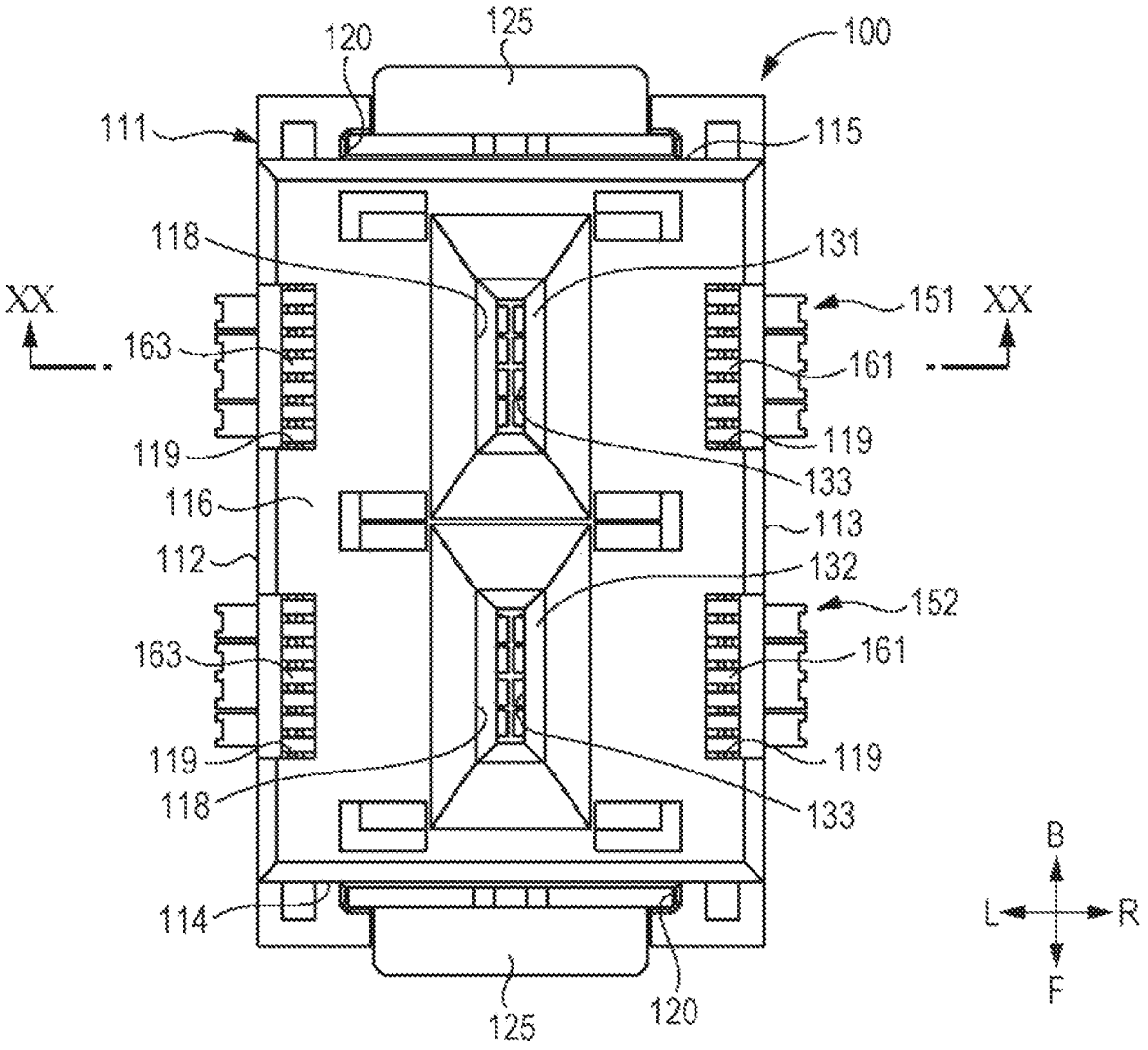
FIG. 16 is a diagram illustrating the connector according to the second embodiment of the disclosure when viewed from above.
Figure 17:
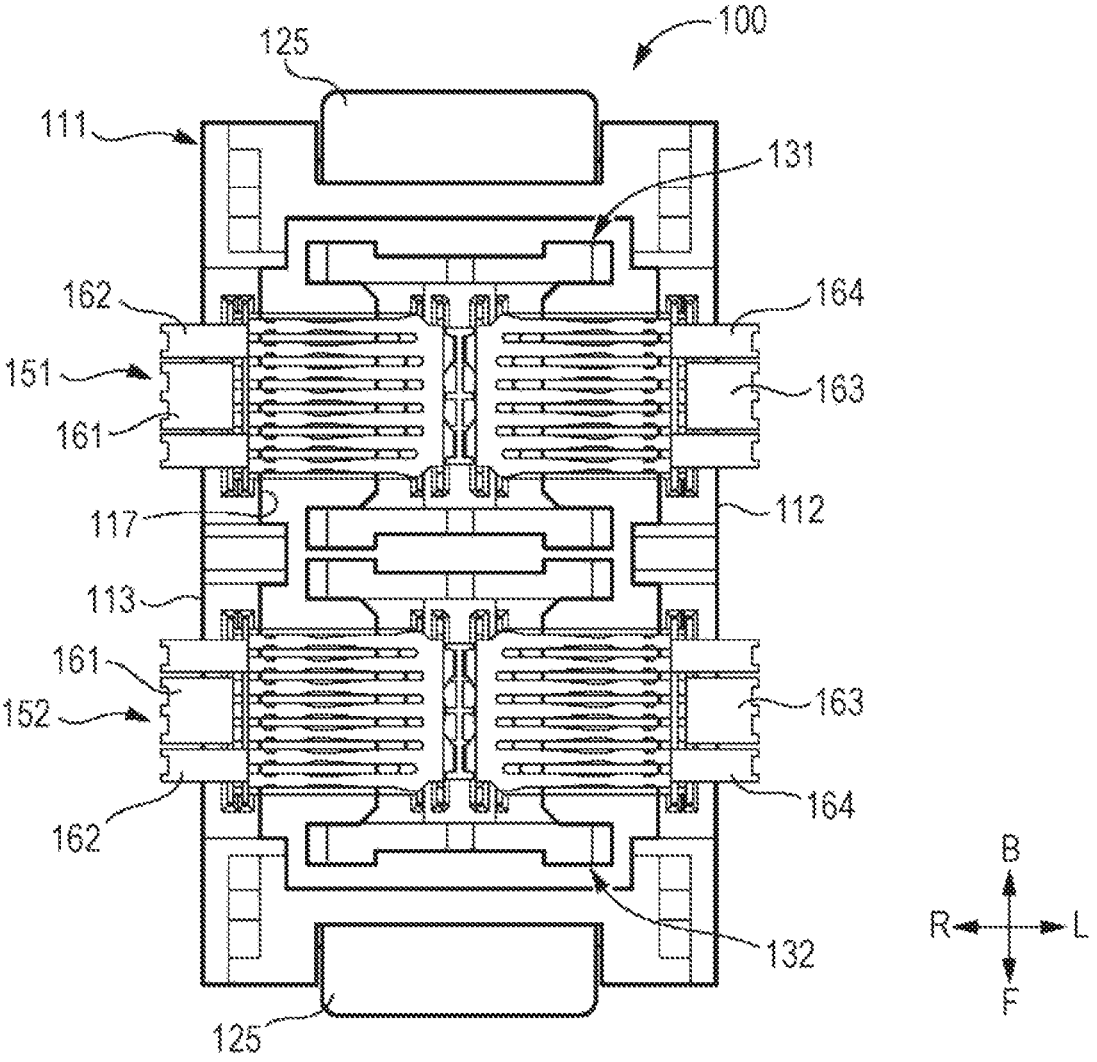
FIG. 17 is a diagram illustrating the connector according to the second embodiment of the disclosure when viewed from below.
Figure 18:
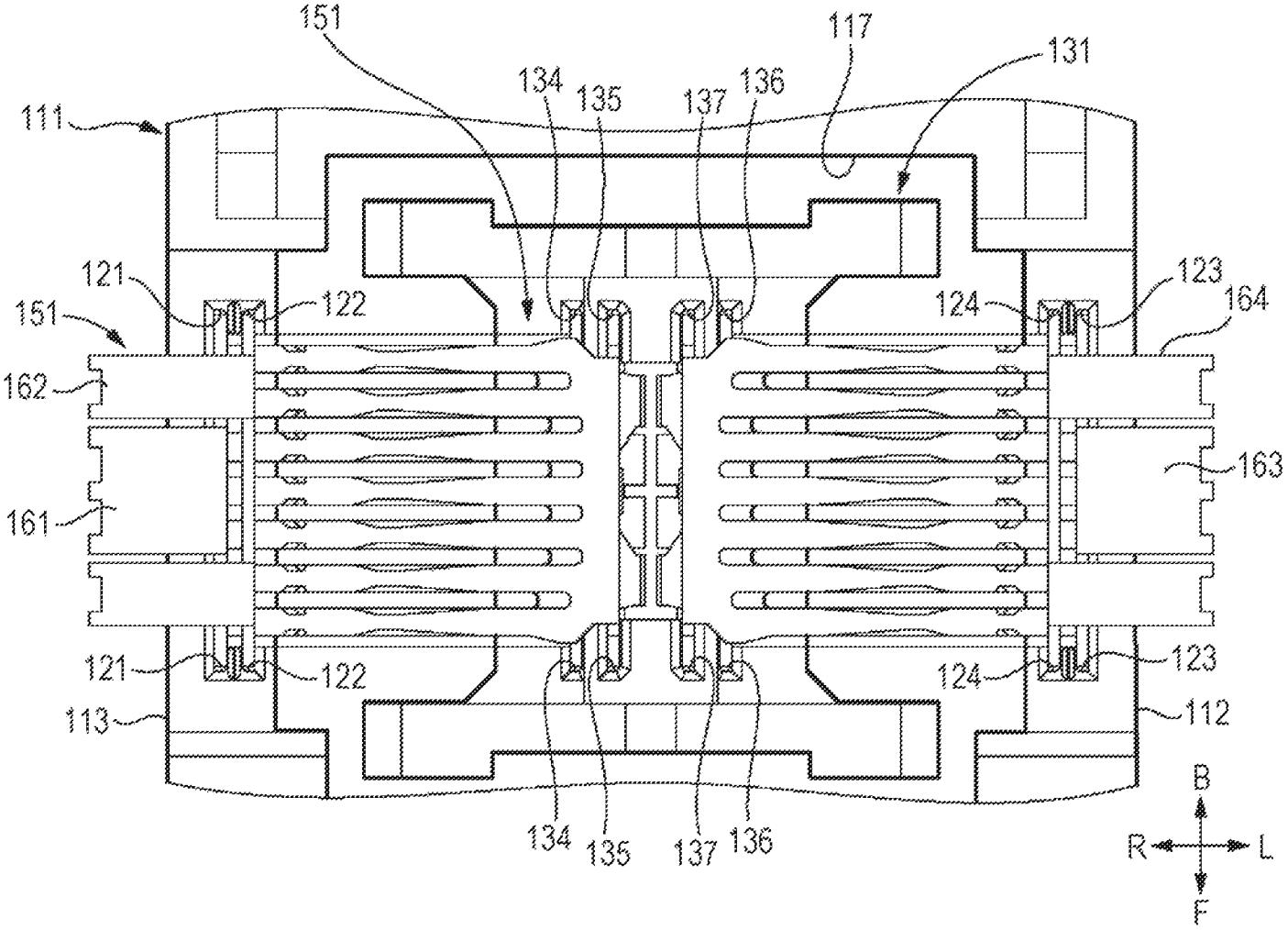
FIG. 18 is a diagram illustrating the rear portion of the connector according to the second embodiment of the disclosure when viewed from below.
Figure 19:
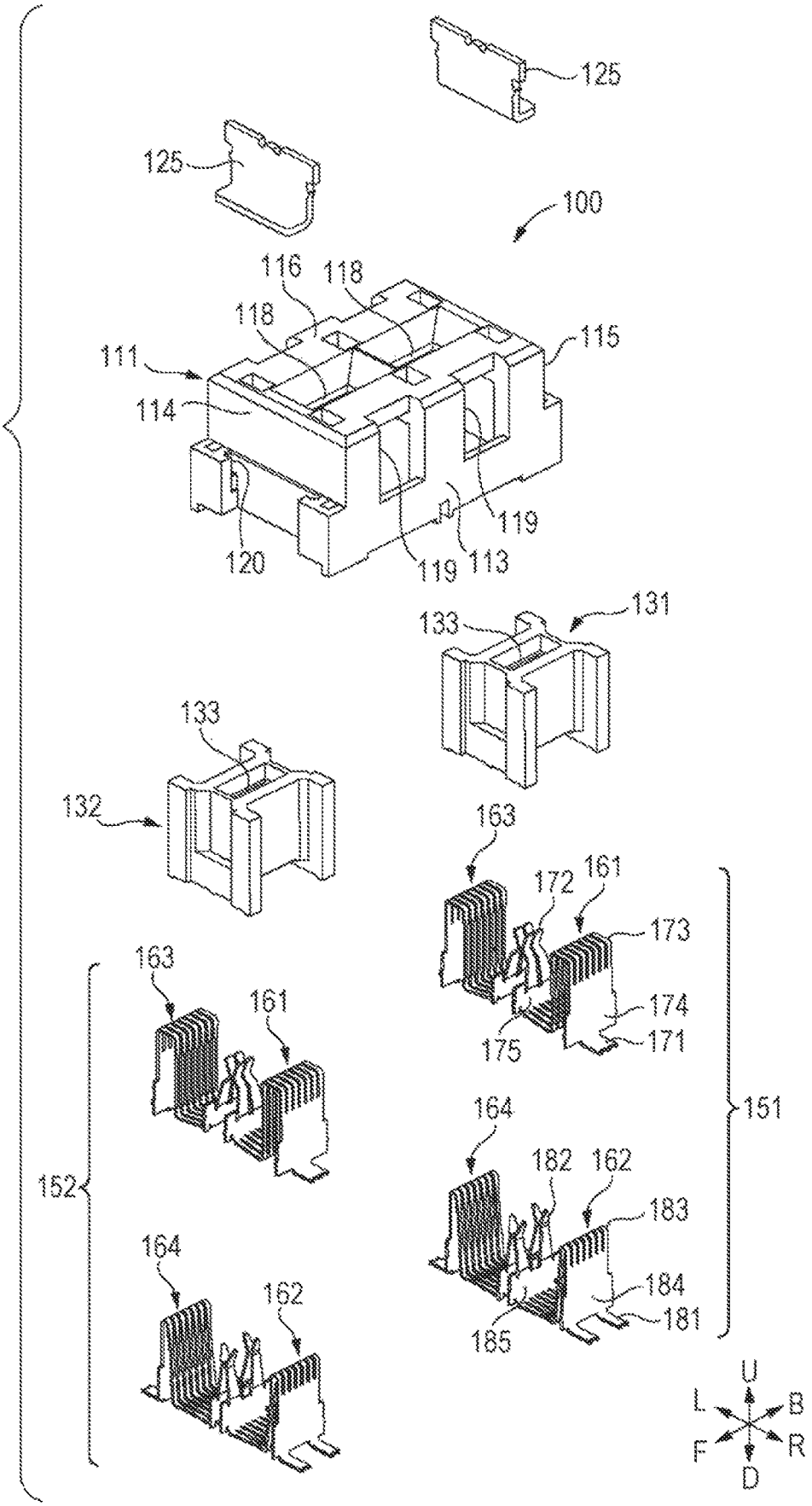
FIG. 19 is an exploded view illustrating the connector according to the second embodiment of the disclosure.
Figure 20:
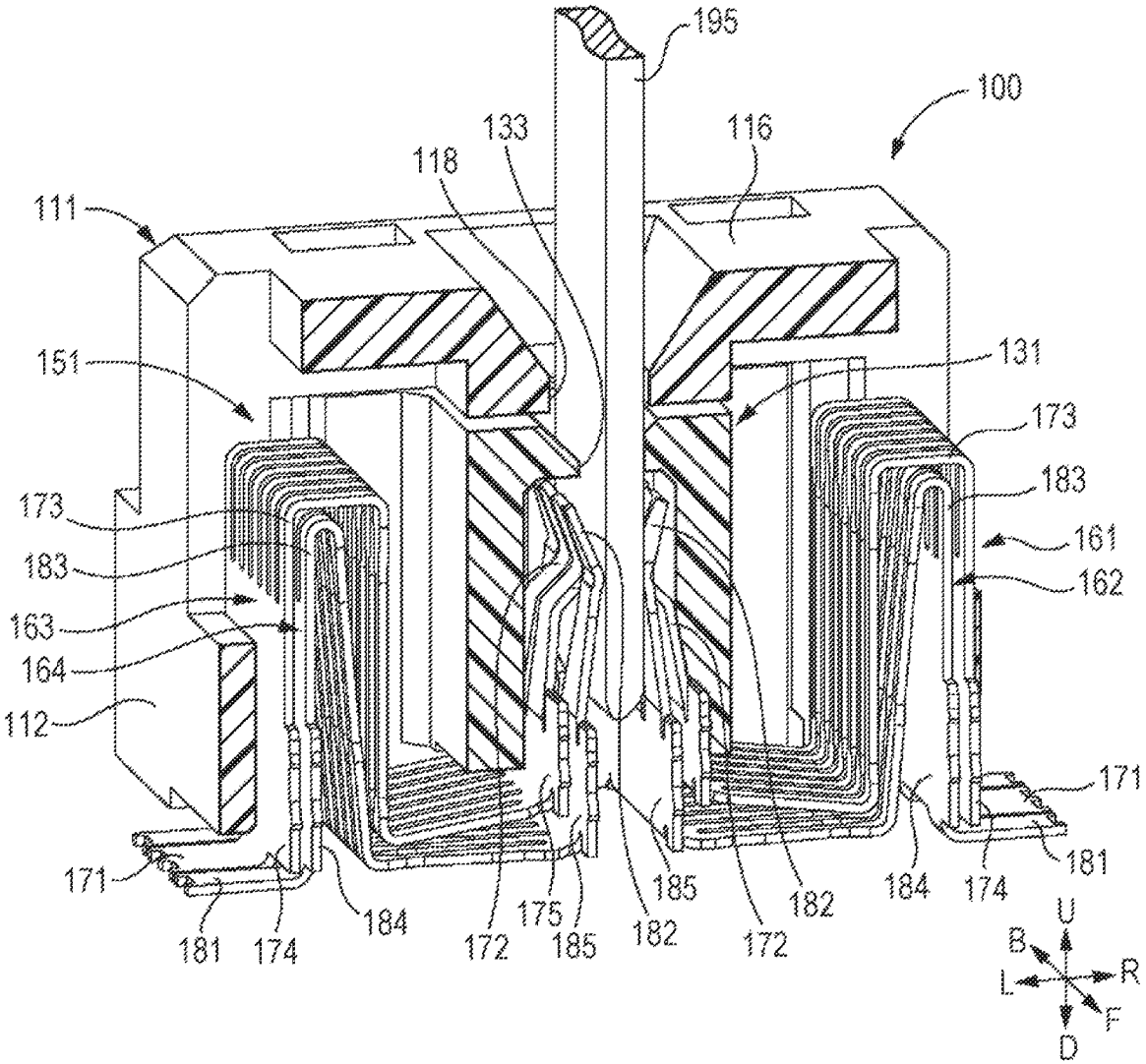
FIG. 20 is a cross-sectional view illustrating the connector when viewed in the direction of arrow XX-XX in FIG. 16.

FIG. 15 illustrates a connector 100 according to a second embodiment of the disclosure. FIG. 16 illustrates the connector 100 when viewed from above. FIG. 17 illustrates the connector 100 when viewed from below. FIG. 18 illustrates the rear portion of the connector 100 when viewed from below. FIG. 19 illustrates the exploded connector 100. FIG. 20 illustrates the cross section of the connector 100 when viewed in the direction of arrow XX-XX in FIG. 16. Further, the connector 100 illustrated in FIG. 20 is in a state where the terminal of the mating connector is connected, and a terminal 195 of the mating connector is illustrated in FIG. 20.

The connector 100 is a floating connector which is mounted in the substrate. The connector 100 includes, as illustrated in FIG. 15, a fixed housing 111, a pair of fixed metal fittings 125, two movable housings 131 and 132, and two terminals 151 and 152.

The fixed housing 111 is formed of an insulating material such as resin. In addition, the fixed housing 111 includes a left wall portion 112, a right wall portion 113, a front wall portion 114, a rear wall portion 115, and an upper wall portion 116, and formed in a box shape of which the lower side is open. In addition, a storage portion 117 is formed in the fixed housing 111, as illustrated in FIG. 17, to store two movable housings 131 and 132 and two terminals 151 and 152. In addition, two terminal insertion holes 118 are formed in the upper wall portion 116 of the fixed housing 111 as illustrated in FIG. 16. The two terminal insertion holes 118 are arranged in the front-rear direction. Each terminal insertion hole 118 communicates with the storage portion 117. For example, in a case where two terminals are provided in the mating connectors to be connected to the connector 100, the two terminals of the mating connector are inserted into the two terminal insertion holes 118 of the connector 100 respectively. In addition, two notches 119 are formed in the upper part of the left wall portion 112 of the fixed housing 111. In addition, two notches 119 are also formed in the upper part of the right wall portion 113 of the fixed housing 111. In addition, a metal fitting attachment portions 120 is formed in each of the front wall portion 114 and the rear wall portion 115 of the fixed housing 111 to attach the fixed metal fitting 125. The fixed housing 111 is fixed to the substrate, where the connector 100 is mounted, by the fixed metal fitting 125.

In addition, as illustrated in FIG. 18, two pairs of terminal support grooves 121 and 122 are formed in the lower part of the rear side of the right wall portion 113 of the fixed housing 111 to support a first terminal piece 161 and a second terminal piece 162 of the terminal 151 respectively. In addition, two pairs of terminal support grooves 123 and 124 are formed in the lower part of the rear side of the left wall portion 112 of the fixed housing 111 to support a third terminal piece 163 and a fourth terminal piece 164 of the terminal 151, respectively. In addition, as can be seen from FIG. 17, two pairs of terminal support grooves, which are the same as the two pairs of terminal support grooves 121 and 122 formed in the lower part of the rear side of the right wall portion 113 of the fixed housing 111, are also formed in the lower part of the front side of the right wall portion 113 of the fixed housing 111. The first terminal piece 161 and the second terminal piece 162 of the terminal 152 are supported to these terminal support grooves. In addition, two pairs of terminal support grooves, which are the same as the two pairs of terminal support grooves 123 and 124 formed in the lower part of the rear side of the left wall portion 112 of the fixed housing 111, are also formed in the lower part of the front side of the left wall portion 112 of the fixed housing 111. The third terminal piece 163 and the fourth terminal piece 164 of the terminal 152 are supported to these terminal support grooves.

The movable housings 131 and 132 are made of an insulating material such as resin in a substantially rectangular cylindrical shape as illustrated in FIG. 19, The two movable housings 131 and 132 are members independent of each other. As can be seen from FIGS. 16 and 17, the two movable housings 131 and 132 are arranged in the storage portion 117 of the fixed housing 111 in the front-rear direction. Specifically, the movable housing 131 is disposed in the rear part of the storage portion 117, and the movable housing 132 is disposed in the front part in the storage portion 117.

As illustrated in FIG. 19, an insertion portion 133 is formed inside each of the movable housings 131 and 132. Contact portions 172 and 182 of the terminal pieces 161 to 164 of the terminal 151 are disposed in the insertion portion 133 of the movable housing 131. In addition, the contact portions 172 and 182 of the terminal pieces 161 to 164 of the terminal 152 are disposed in the insertion portion 133 of the movable housing 132. In addition, as illustrated in FIG. 16, the insertion portion 133 of the movable housing 131 and the insertion portion 133 of the movable housing 132 are disposed at positions corresponding to the two terminal insertion holes 118 of the fixed housing 111 in the up-down direction. The terminal of the mating connector passed in the terminal insertion holes 118 is inserted into the insertion portion 133.

In addition, as illustrated in FIG. 18, four pairs of terminal support grooves 134 to 136 are formed in the lower part of the movable housing 131 to support the terminal pieces 161 to 164 of the terminal 151. In addition, four pairs of terminal support grooves, which are the same as the four pairs of terminal support grooves 134 to 136 formed in the lower part of the movable housing 131, are formed also in the lower part of the movable housing 132. The terminal pieces 161 to 164 of the terminal 152 are supported to these four pairs of terminal support grooves.

In FIG. 19, the terminal 151 is attached to the movable housing 131, and disposed in the rear part of the fixed housing 111 together with the movable housing 131. In addition, the terminal 152 is attached to the movable housing 132, and disposed in the front part of the fixed housing 111 together with the movable housing 132.

The terminal 151 includes the first terminal piece 161, the second terminal piece 162, the third terminal piece 163, and the fourth terminal piece 164. As illustrated in FIG. 20, the first terminal piece 161 and the second terminal piece 162 are disposed on the might side of the movable housing 131 to be generally overlapped in the up-down direction. In addition, the third terminal piece 163 and the fourth terminal piece 164 are disposed on the left side of the movable housing 131 to be generally overlapped in the up-down direction. The terminal pieces 161 to 164 are formed by a conductive plate such as a metal plate.

Figure 21:
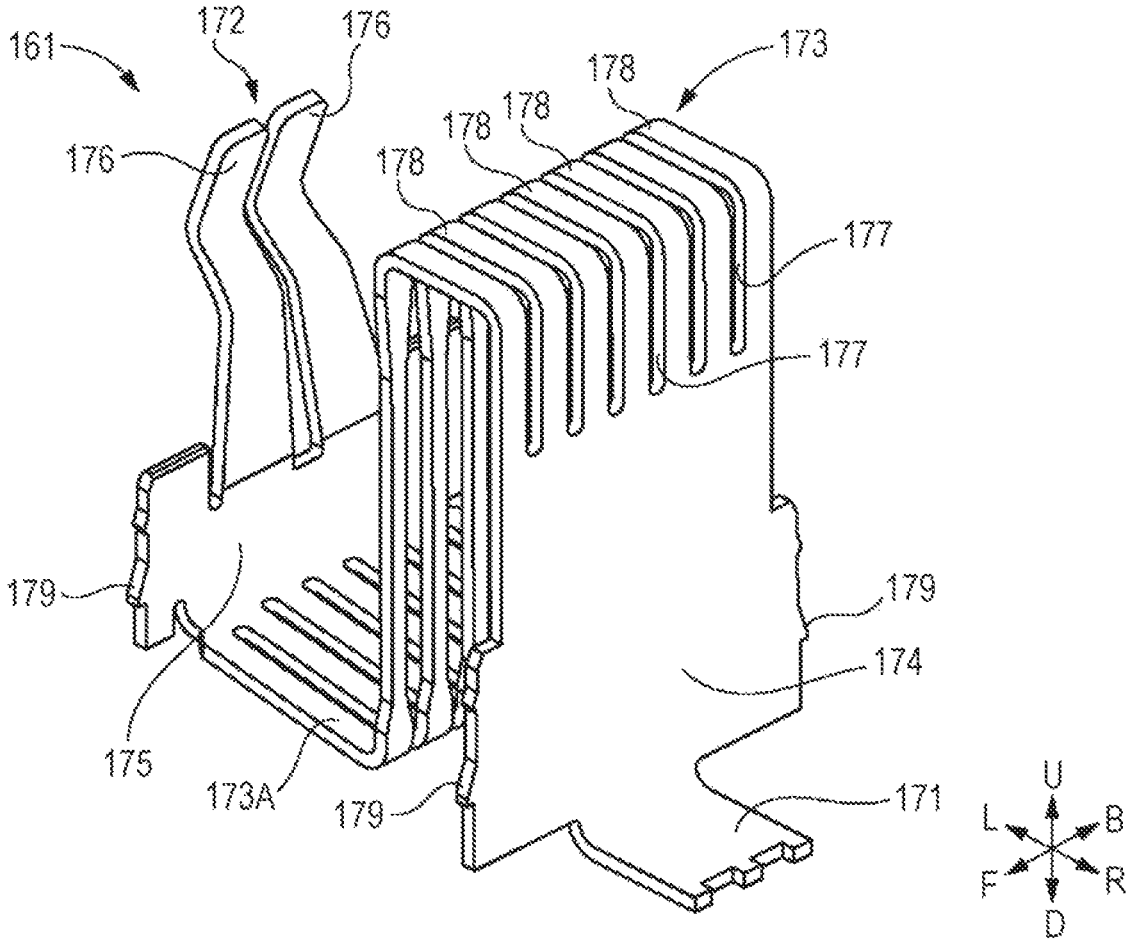
FIG. 21 is a perspective view illustrating the first terminal piece in the connector according to the second embodiment of the disclosure.

FIG. 21 illustrates the first terminal piece 161 of the terminal 151. As illustrated in FIG. 21, the first terminal piece 161 includes a connection portion 171 to be connected to a circuit provided in the machine or the substrate, the contact portion 172 to come in contact with the terminal of the mating connector, and a spring portion 173 to connect the connection portion 171 and the contact portion 172 such that the contact portion 172 becomes movable in the left-right direction, the front-rear direction, and the up-down direction with respect to the connection portion 171.

The connection portion 171 is formed on one end side of the first terminal piece 161 in the length direction. The connection portion 171 includes a single connector which extends in the left-right direction.

The contact portion 172 is formed on the other end side of the first terminal piece 161 in the length direction. The contact portion 172 includes two contactors 176, The contactors 176 extend in the up-down direction. In addition, the upper end portion of each contactor 176 is bent in a "<" shape to protrude toward the left side. The left surface of the bent portion becomes a contact surface which comes in contact with the terminal of the mating connector.

The spring portion 173 is formed between the connection portion 171 and the contact portion 172. A plurality (for example, six) of slits 177 is formed in the spring portion 173. With the plurality of slits 177 formed in the spring portion 173, the spring portion 173 is divided into a plurality (for example, seven) of spring elements 178. The spring portion 173 is bent substantially in a crank shape or an S shape almost similarly to the spring portion 57 of the first terminal piece 51 of the first embodiment. In addition, the width of each spring element 178 is changed, as illustrated in FIG. 21, in the process that the corresponding spring element 178 extends from the connection portion 171 to the contact portion 172.

In addition, an engaging portion 179 is formed in each of the front end and the rear end of a joining portion 174 which joins the connection portion 171 and the spring portion 173. As illustrated in FIG. 18, the front end and the rear end of the joining portion 174 of the first terminal piece 161 of the terminal 151 are inserted into the pair of terminal support grooves 121 which is formed in the lower part of the rear side of the right wall portion 113 of the fixed housing 111. When the front end and the rear end of the joining portion 174 are inserted into the pair of terminal support grooves 121, the engaging portion 179 is engaged to an engaging concave portion (not illustrated) which is formed in the bottom surface of the terminal support groove 121.

In addition, as illustrated in FIG. 21, the engaging portion 179 is formed also in each of the front end and the rear end of a joining portion 175 which joins the spring portion 173 and the contact portion 172. As illustrated in FIG. 18, the front end and the rear end of the joining portion 175 of the first terminal piece 161 of the terminal 151 are inserted into the pair of terminal support grooves 134 which is formed in the lower part of the movable housing 131. When the front end and the rear end of the joining portion 175 are inserted into the pair of terminal support grooves 134, the engaging portion 179 is engaged to an engaging concave portion (not illustrated) which is formed in the bottom surface of the terminal support groove 134.

Figure 22:
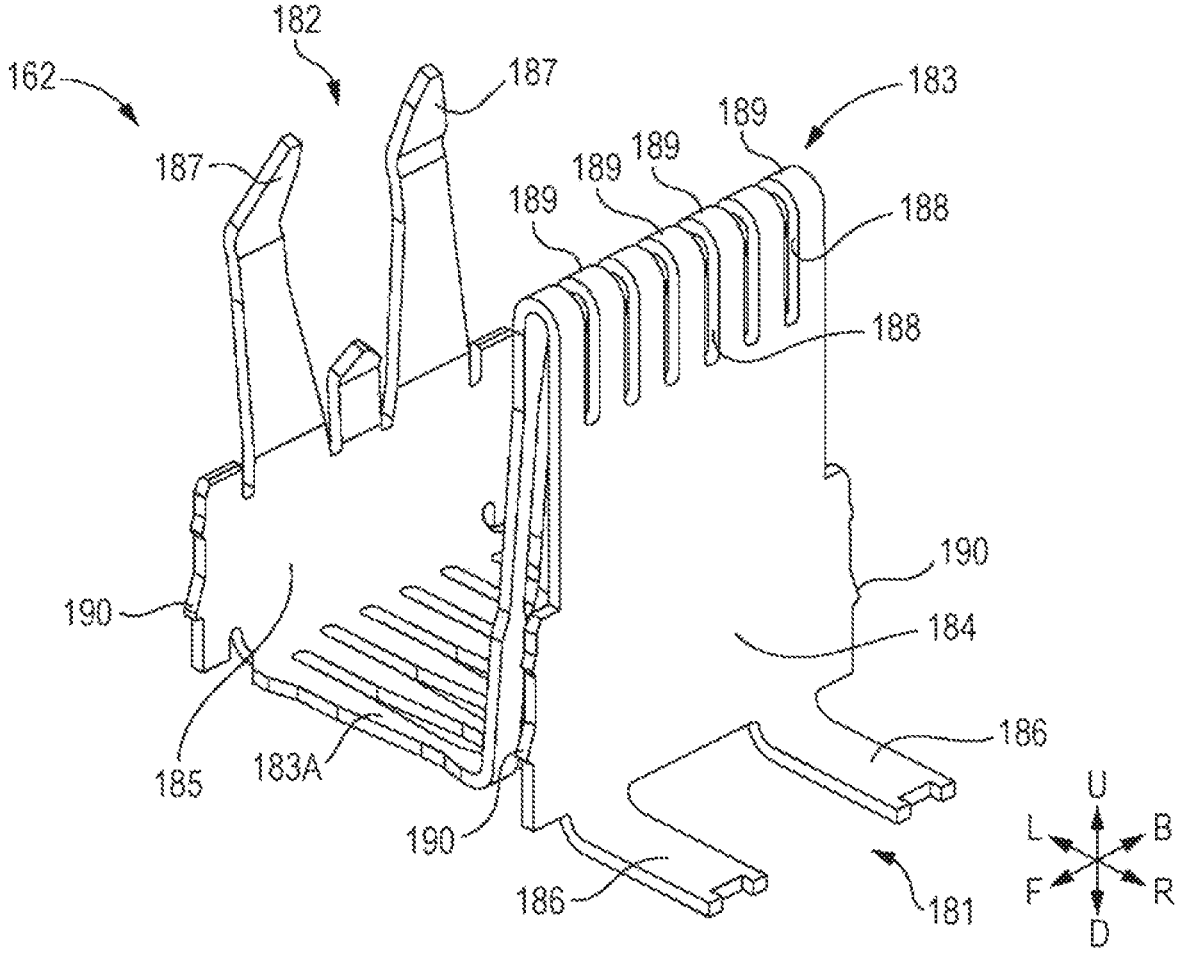
FIG. 22 is a perspective view illustrating the second terminal piece in the connector according to the second embodiment of the disclosure.
Figure 23:
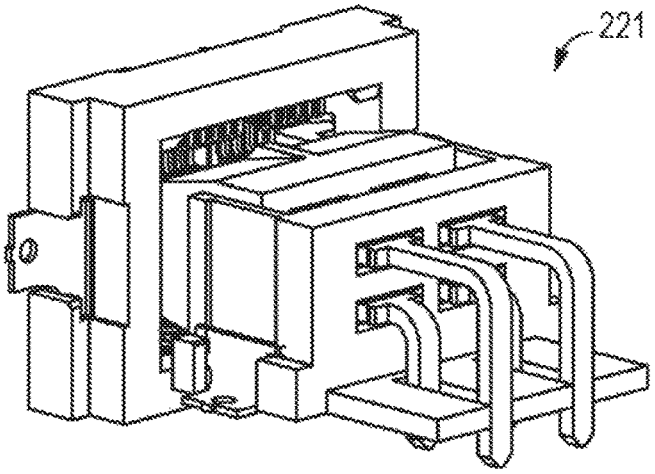
FIG. 23 is a perspective view illustrating a connector according to a modification of the disclosure.

FIG. 22 illustrates the second terminal piece 162 of the terminal 151. As illustrated in FIG. 22, the second terminal piece 162 includes a connection portion 181, a contact portion 182, and a spring portion 183. The connection portion 181 includes two connectors 186 which extend in the left-right direction. The contact portion 182 includes two contactors 187 which extend in the up-down direction. The upper end portion of each contactor 187 is bent in a "<" shape to protrude toward the left side. The left surface of the bent portion becomes a contact surface which comes in contact with the terminal of the mating connector. A plurality of slits 188 is formed in the spring portion 183, and thus the spring portion 183 is divided into a plurality of spring elements 189. In addition, the spring portion 183 is bent substantially in a crank shape or an S shape almost similarly to the spring portion 77 of the second terminal piece 71 of the first embodiment. In addition, the width of each spring element 189 of the spring portion 183 is changed, as illustrated in FIG. 22, in the process that the corresponding spring element 189 extends from the connection portion 181 to the contact portion 182.

In addition, an engaging portion 190 is formed in each of the front end and the rear end of a joining portion 184 which joins the connection portion 181 and the spring portion 183. As illustrated in FIG. 18, the front end and the rear end of the joining portion 184 of the second terminal piece 162 of the terminal 151 are inserted into the pair of terminal support grooves 122 which is formed in the lower part of the rear side of the right wall portion 113 of the fixed housing 111. When the front end and the rear end of the joining portion 184 are inserted into the pair of terminal support grooves 122, the engaging portion 190 is engaged to an engaging concave portion (not illustrated) which is formed in the bottom surface of the terminal support groove 122.

In addition, as illustrated in FIG. 22, the engaging portion 190 is formed also in each of the front end and the rear end of a joining portion 185 which joins the spring portion 183 and the contact portion 182. As illustrated in FIG. 18, the front end and the rear end of the joining portion 185 of the second terminal piece 162 of the terminal 151 are inserted into a pair of terminal support grooves 135 which is formed in the lower part of the movable housing 131. When the front end and the rear end of the joining portion 185 are inserted into the pair of terminal support grooves 135, the engaging portion 190 is engaged to an engaging concave portion (not illustrated) which is formed in the bottom surface of the terminal support groove 135.

The third terminal piece 163 of the terminal 151 includes, as illustrated in FIG. 19, the same shape and structure as the first terminal piece 161 of the terminal 151, and is disposed to face the first terminal piece 161 of the terminal 151 in the left-right direction. In addition, as illustrated in FIG. 18, the front end and the rear end of the joining portion 174 of the third terminal piece 163 are inserted into the pair of terminal support grooves 123 formed in the lower part of the rear side of the left wall portion 112 of the fixed housing 111, and engaged thereto. In addition, the front end and the rear end of the joining portion 175 of the third terminal piece 163 of the terminal 151 are inserted into a pair of terminal support grooves 136 which is formed in the lower part of the movable housing 131, and engaged thereto.

The fourth terminal piece 164 of the terminal 151 includes, as illustrated in FIG. 19, the same shape and structure as the second terminal piece 162 of the terminal 151, and is disposed to face the second terminal piece 162 of the terminal 151 in the left-right direction. In addition, as illustrated in FIG. 18, the front end and the rear end of the joining portion 184 of the fourth terminal piece 164 are inserted into the pair of terminal support grooves 124 formed in the lower part of the rear side of the left wall portion 112 of the fixed housing 111, and engaged thereto.

The front end and the rear end of the joining portion 185 of the fourth terminal piece 164 are inserted into a pair of terminal support grooves 137 which is formed in the lower part of the movable housing 131, and engaged thereto.

In addition, as illustrated in FIG. 20, the first terminal piece 161 and the second terminal piece 162 are disposed in the terminal 151 to be overlapped via a gap in the direction perpendicular to surfaces 173A and 183A of the spring portions 173 and 183 until the spring portions 173 and 183 reach from one ends of the spring portions 173 and 183 in the length direction to the other ends. The arrangement of the first terminal piece 161 and the second terminal piece 162 is the same as the arrangement of the first terminal piece 51 and the second terminal piece 71 in the first embodiment. In addition, the third terminal piece 163 and the fourth terminal piece 164 are disposed in the terminal 151 to be overlapped via a gap in the direction perpendicular to surfaces 173A and 183A of the spring portions 173 and 183 until the spring portions 173 and 183 reach from one ends of the spring portions 173 and 183 in the length direction to the other ends.

In addition, in the terminal 151, the connection portion 171 of the first terminal piece 161 is disposed between the two contactors 186 of the connection portion 181 of the second terminal piece 162. In addition, the two contactors 176 of the contact portion 172 of the first terminal piece 161 are disposed between the two contact pieces 187 of the contact portion 182 of the second terminal piece 162. Similarly, the connection portion 171 of the third terminal piece 163 is disposed between the two contactors 186 of the connection portion 181 of the second terminal piece 162. In addition, the two contactors 176 of the contact portion 172 of the third terminal piece 163 are disposed between the two contact pieces 187 of the contact portion 182 of the fourth terminal piece 164. In addition, the contact surfaces between the two contactors 176 of the first terminal piece 161 and the two contactors 187 of the second terminal piece 162, and the contact surfaces between the two contactors 176 of the third terminal piece 163 and the two contactors 187 of the fourth terminal piece 164 face each other.

In addition, the engaging portions 179 and 190 formed in the joining portions 174 and 184 of the terminal pieces 161 to 164 are inserted into the terminal support grooves 121 to 124 of the fixed housing 111 respectively, and engaged thereto, so that the terminal 151 is fixed to the fixed housing 111. In addition, the engaging portions 179 and 190 formed in the joining portions 175 and 185 of the terminal pieces 161 to 164 in the terminal 151 are inserted into the terminal support grooves 134 to 136 of the movable housing 131 respectively, and engaged thereto, so that the movable housing 131 is movably supported to the fixed housing 111 by the terminal 151.

In addition, the terminal 152 has the same shape and structure as the terminal 151. In addition, the terminal 152 is fixed to the fixed housing 111 by the same structure as the terminal 151. In addition, the terminal 152 movably supports the movable housing 132 to the fixed housing 111 by the same structure as the terminal 151.

The connector 100 according to the second embodiment of the disclosure which has the above configuration has the same operational effects as the connector of the first embodiment of the disclosure 1. Further, in the connector 100 of the second embodiment, the movable housing 131 and the movable housing 132 can independently move with respect to the fixed housing 111 or the substrate where the connector 100 is mounted. Therefore, for example, as described above, in a case where the mating connector and the connector 100 having two terminals are connected, the positional deviation between one terminal of the mating connector connected to the terminal 151 and the other terminal of the mating connector connected to the terminal 152 can be absorbed by the movement of the movable housing 131 or the movable housing 132. In addition, each of the terminals 151 and 152 is formed by four terminal pieces 161 to 164 in the connector 100 of the second embodiment. In this way, the current capacity of the terminal can be increased by increasing the number of terminal pieces forming one terminal.

Further, in each terminal piece of each terminal of the electrical connector of the disclosure, the number of connectors in the connection portion, the number of contactors in the contact portion, the number of slits in the spring portion, or the number of spring elements in the spring portion is not limited. In addition, the spring portion may be formed without slits. In addition, the number of terminal pieces forming each terminal is not limited. In addition, the number of slits or the number of spring elements may be different between two terminals disposed to be overlapped.

In addition, in the above embodiments, the shapes of the spring portions 57 and 77 (173 and 183) of the terminal pieces 51 and 71 (161 to 164) have been exemplified as a general crank or S shape as illustrated in FIG. 12 or the like. However, the shape of the spring portion is not limited thereto. For example, the number of bent points of the spring portion is not limited, the spring portion may be formed in a straight line without bent points, or the spring portion may be formed in, for example, a sine curve shape.

In addition, in the first embodiment, the entire spring portion 57 of the first terminal piece 51 and the entire spring portion 77 of the second terminal piece 71 have been configured to be overlapped to each other, but the disclosure is not limited thereto. A part of the spring portion 57 of the first terminal piece 51 and a part of the spring portion 77 of the second terminal piece 71 may be configured to be overlapped to each other.

In addition, in the disclosure, three or more terminal pieces may be disposed such that the spring portions are overlapped via a gap in the direction perpendicular to the surfaces of the spring portions.

In addition, in the connector 1 of the first embodiment, as illustrated in FIG. 1, most of the movable housing 31 is contained in the space inside the fixed housing 11, but a part of the movable housing 31 may lie greatly outside the fixed housing 11. For example, the dimension of the movable housing 31 in the up-down direction may be significantly larger than the dimension of the fixed housing 11 in the up-down direction, and the movable housing 31 may lie greatly upward from the space inside the fixed housing 11.

In addition, the number of movable housings provided in one fixed housing may be three or more.

Figure 24A:
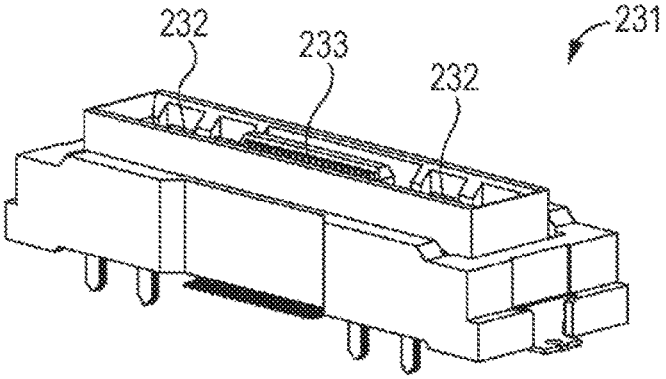
FIGS. 24A and 24B are perspective views illustrating a connector according to another modification of the disclosure and the mating connector thereof.
Figure 24B:
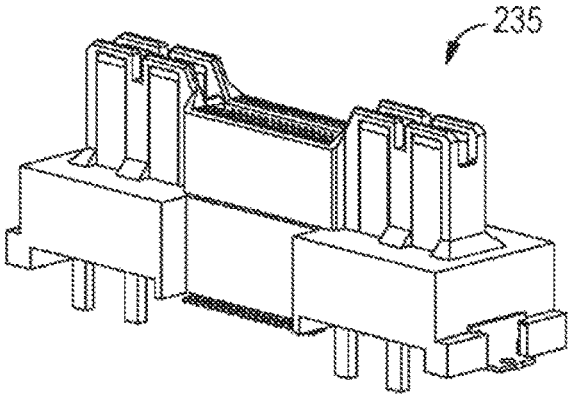

In addition, the disclosure can be applied also to a connector right angle type as illustrated in FIG. 22. In addition, the disclosure may be applied also to a connector 231 of a composite type which includes a power source terminal 232 and a signal terminal 233 as illustrated in FIG. 24A. Further, a connector 235 in FIG. 24B is a mating connector which can connect the connector 231.

In addition, the disclosure may be appropriately modified within a scope not departing from the spirit or the ideas of the disclosure which can be read from the claims and specification, the electrical connector according to the modification e also included in the disclosure. The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An electrical connector, comprising:

a terminal that includes two terminal pieces;

a fixed housing that is fixed to a machine or a substrate; and a movable housing that is movably supported to the fixed housing by the terminal, wherein each of the terminal pieces is formed of a conductive plate, wherein a connection portion is formed on one end side of each of the terminal pieces in a length direction and connected to a circuit provided in the machine or the substrate, wherein a contact portion is formed on another end side of each of the terminal pieces in the length direction and comes in contact with a terminal of a mating connector, wherein a spring portion is formed in each of the terminal pieces and connects the connection portion and the contact portion such that the contact portion is movable with respect to the connection portion between the connection portion and the contact portion, wherein the two terminal pieces are disposed such that at least parts of the spring portions of the two terminal pieces are overlapped via a gap in a direction perpendicular to a surface of the spring portion, and wherein the spring portion of each of the two terminal pieces is bent in a crank shape or an S shape.

2. The electrical connector according to claim 1, wherein an insertion portion is provided in the movable housing to insert the terminal of the mating connector, wherein the contact portion of each of the terminal pieces includes a contact surface to be in contact with the terminal of the mating connector, and wherein the contact portion of each of the two terminal pieces is disposed in the insertion portion such that the contact surfaces of the contact portions face each other.

3. The electrical connector according to claim 1, wherein a size of a gap between the spring portions of the two terminal pieces is changed in a process that the spring portions of the two terminal pieces extend from the connection portions of the two terminal pieces to the contact portions of the two terminal pieces.

4. The electrical connector according to claim 1, comprising:

a plurality of the terminals; and a plurality of the movable housings, wherein the plurality of the movable housings is independently and movably supported to the fixed housing by the plurality of the terminals.

5. The electrical connector according to claim 1, wherein the spring portion of one of the two terminal pieces extends from an end portion of the connection portion in a first direction, extends in a second direction crossing the first direction after being bent to the second direction, extends in a third direction crossing the second direction after being bent to the third direction, extends in the second direction after being bent to the second direction, extends in the first direction after being bent to the first direction, and then reaches an end portion of the contact portion.

6. The electrical connector according to claim 1, wherein a slit is formed in the spring portion of each of the terminal pieces such that the slit passes through the terminal piece from a front surface to a rear surface, and extends in a length direction of the terminal piece.

7. The electrical connector according to claim 6, wherein the spring portion of each of the two terminal pieces includes a plurality of elongated spring elements, wherein the plurality of spring elements are separated by the slit, and wherein a width of each of the spring elements varies along said length direction.

* * * * *